US007467446B2

(12) United States Patent
Pourdeyhimi et al.

(10) Patent No.: US 7,467,446 B2
(45) Date of Patent: Dec. 23, 2008

(54) SYSTEM AND METHOD FOR REDUCING JET STREAKS IN HYDROENTANGLED FIBERS

(75) Inventors: Behnam Pourdeyhimi, Cary, NC (US); Hooman Vahedi Tafreshi, Raleigh, NC (US); Nagendra Anantharamaiah, Raleigh, NC (US)

(73) Assignee: North Carolina State University, Raleigh, NC (US)

( * ) Notice: Subject to any disclaimer, the term of this patent is extended or adjusted under 35 U.S.C. 154(b) by 0 days.

(21) Appl. No.: 11/692,680

(22) Filed: Mar. 28, 2007

(65) Prior Publication Data

US 2007/0226970 A1 Oct. 4, 2007

Related U.S. Application Data

(60) Provisional application No. 60/786,541, filed on Mar. 28, 2006.

(51) Int. Cl.
*D04H 1/46* (2006.01)

(52) U.S. Cl. ..... 28/104; 28/167

(58) Field of Classification Search ..... 28/104, 28/105, 106, 167; 239/556, 560, 561, 558, 239/554; 68/205 R
See application file for complete search history.

(56) References Cited

U.S. PATENT DOCUMENTS 1,958,038 A * 5/1934 Fraser ..... 239/447
3,403,862 A 10/1968 Dworjanyn
3,508,308 A * 4/1970 Bunting, Jr. et al. ..... 28/104
3,603,512 A * 9/1971 Ham ..... 239/504
3,895,449 A * 7/1975 Chance et al. ..... 34/638
3,943,639 A * 3/1976 Vits ..... 34/638
4,069,563 A * 1/1978 Contractor et al. ..... 28/105
4,146,663 A 3/1979 Ikeda et al.

(Continued)

FOREIGN PATENT DOCUMENTS

FR 2 752 247 A 2/1998

(Continued)

OTHER PUBLICATIONS

Begenir et al., "The Role of Orifice Design in Hydroentanglement", Master of Science Thesis, North Carolina State University, Raleigh.

(Continued)

*Primary Examiner*—Amy B Vanatta
(74) *Attorney, Agent, or Firm*—Alston & Bird LLP

(57) ABSTRACT

A system for hydroentangling a fabric material, while reducing the incidence of jet streaks therein, is provided. Various embodiments of the present invention provide an elongate hydroentangling jet strip spaced apart from the fabric material and extending substantially across a width of the fabric perpendicular to the processing direction. The strip defines a first row of orifices, each having a first diameter. The first plurality of orifices is spaced apart along a width of the elongate strip. The strip further defines a second plurality of orifices disposed downstream from the first plurality of orifices in the processing direction and offset therefrom along the width of the elongate strip. The second plurality of orifices each define a second diameter smaller than the first diameter such that fluid streams generated thereby impart a correspondingly smaller impact force on the fabric material than fluid streams generated by the first plurality of orifices.

35 Claims, 14 Drawing Sheets

U.S. PATENT DOCUMENTS

| | | | | |
|---|---|---|---|---|
| 4,805,275 | A | 2/1989 | Suzuki et al. | |
| 4,880,168 | A | 11/1989 | Randall, Jr. et al. | |
| 4,960,630 | A * | 10/1990 | Greenway et al. | 428/131 |
| 5,618,610 | A * | 4/1997 | Tomita et al. | 428/152 |
| 5,737,813 | A | 4/1998 | Sternlieb et al. | |
| 6,063,717 | A | 5/2000 | Ishiyama et al. | |
| 6,105,222 | A | 8/2000 | Fleissner | |
| 6,253,429 | B1 | 7/2001 | Zolin | |
| 6,557,223 | B2 | 5/2003 | Greenway et al. | |
| 6,571,441 | B1 | 6/2003 | Kobayashi et al. | |
| 6,668,436 | B2 | 12/2003 | Noelle et al. | |
| 6,877,196 | B2 | 4/2005 | Oathout et al. | |
| 7,178,210 | B2 * | 2/2007 | Noelle et al. | 28/104 |
| 2002/0078538 | A1 * | 6/2002 | Ngai | 28/104 |
| 2002/0142689 | A1 * | 10/2002 | Levit | 442/381 |
| 2003/0101558 | A1 * | 6/2003 | Sternlieb et al. | 28/167 |
| 2004/0010894 | A1 | 1/2004 | Goldwasser et al. | |
| 2005/0273989 | A1 | 12/2005 | Dixon et al. | |
| 2006/0124772 | A1 | 6/2006 | Pourdeyhimi et al. | |
| 2006/0137155 | A1 | 6/2006 | Louis Dit Picard et al. | |

FOREIGN PATENT DOCUMENTS

| | | | |
|---|---|---|---|
| WO | WO 03/006224 | A1 | 1/2003 |
| WO | WO 2004/113602 | A1 | 12/2004 |
| WO | WO 2005/123616 | A2 | 12/2005 |
| WO | WO 2006/063110 | A2 | 6/2006 |

OTHER PUBLICATIONS

Ghassemieh et al., "Effect of Nozzle Geometry on the Flow Characteristics of Hydroentangling Jets", *Textile Res. J.*, 2003, pp. 444-450, vol. 73 No. 5.

Shim, E., and Pourdeyhimi, B., "A Note on Jet Streaks in Hydroentangled Nonwovens", *Textile Research Journal*, 2005, pp. 569-577, vol. 75, No. 7.

Tafreshi et al., "The Effects of Nozzle Geometry on Waterjet Breakup at High Reynolds Numbers", *Experiments in Fluids*, 2003, pp. 364-371, vol. 35.

* cited by examiner

Control

Sample

SYSTEM AND METHOD FOR REDUCING JET STREAKS IN HYDROENTANGLED FIBERS

CROSS-REFERENCE TO RELATED APPLICATIONS

This application claims priority from U.S. Provisional Application No. 60/786,541, filed on Mar. 28, 2006, which is hereby incorporated by reference herein in its entirety.

FIELD OF THE INVENTION

The various embodiments of the present invention relate generally to the improvement of hydroentanglement processes for producing nonwoven textiles.

BACKGROUND OF THE INVENTION

Hydroentanglement or "spunlacing" is a process used for mechanically bonding a web of loose fibers to directly form a fabric. Such a class of fabric belongs to the "nonwoven" family of engineered fabrics. The underlying mechanism in hydroentanglement is the subjecting the fibers to a non-uniform pressure field created by a successive bank of high-velocity fluid streams. The impact of the fluid streams with the fibers, while the fibers are in contact with adjacent fibers, displaces and rotates the adjacent fibers, thereby causing entanglement of the fibers. During these relative displacements of the fibers, some of the fibers twist around others and/or interlock with other fibers to form a strong structure, due at least in part, to frictional forces between the interacting fibers. The resulting product is a highly compressed and uniform fabric formed from the entangled fibers. Such a hydroentangled fabric is often highly flexible, yet very strong, generally outperforming woven and knitted fabric counterparts in performance. The hydroentanglement process is thus a high-speed, low-cost alternative to other methods of producing fabrics. Hydroentanglement machines can, for example, produce fabric as fast as about 700 meters of fabric or more per minute, wherein the fabric may be between about 1 and about 6 meters wide. In operation, the hydroentanglement process depends on particular properties of coherent high-speed fluid streams produced by directing pressurized water through orifices defined in strips engaged with manifolds for dispensing water at a selected pressure through the orifices to form the fluid streams.

In conventional hydroentangling systems, a single manifold strip defines a double row of orifices of identical size for creating substantially identical fluid streams. In addition, it is typical to utilize a series of manifolds, wherein each presents a hydroentangling fluid stream driven by a higher pressure than the previous fluid stream. However, in such conventional systems, the aligned fluid streams create "jet streaks" in the nonwoven fabrics. Particularly, the last row of fluid streams create streaks in the nonwoven fabric because these fluid streams operate at the highest pressure, thus impacting the nonwoven fabric with the most force and creating ridges 300 (i.e. "jet streaks") (see FIG. 3) in the finished fabric 110 in the spaces between the impact regions of the fluid streams. Also, because no processing elements and/or fluid streams are present after the last manifold in such conventional systems, the jet streaks created by the last set of fluid streams remain undisturbed and present in the finished nonwoven product produced by such systems.

The ridges 300 and/or jet streaks produced by conventional hydroentangling systems are undesirable in most of the applications where aesthetics and structural integrity of the produced fabric are important. For example, the ridges are clearly visible when the fabric is brought against light for example as in window treatments or in upholstery applications. However, eliminating and/or reducing jet streaks in hydroentangled fabrics has remained troublesome for manufacturers of nonwoven fabrics. One conventional method for obtaining a uniform surface on a hydroentangled fabric involves the introduction of transverse oscillations at regular intervals in the fluid stream curtain (see, for example, U.S. Pat. No. 6,105,222). This method involves oscillating the manifold in the transverse direction (perpendicular to the fabrics' processing direction (as described further herein). The oscillatory movement in such a technique is regulated by connecting the manifold to a reciprocating unit (such as a vibrator). This method requires a major capital investment as well as an additional source of energy for vibrating heavy manifolds. Furthermore, the final outcome of such a technique transforms the linear ridges or jet streaks into a "zigzag" pattern without really eliminating and/or diminishing the height of such streaks. Another conventional method practiced in industry involves the introduction of 4-row nozzle-strips having nozzles with the same diameter in a staggered arrangement (see, for example, U.S. Pat. No. 6,571,441). This method also suffers from some technical problems: first, since the all the nozzles have identical diameters, the resulting fluid streams have the same impact energy and the jet-streaks caused by the last row of nozzles will permanently stay on the fabric; and second, such a technique increases the water consumption of the designated manifold by a factor of 4.

There are a few additional documented attempts at reducing and/or preventing jet-streaks in finished nonwoven fabrics. However, these hydroentangling systems have proven either inefficient or too expensive to be commercially viable. These include methods disclosed in: U.S. Pat. No. 6,877,196 (wherein fluid streams are disclosed with two opposite offset angles (towards the sides of the fabric) with respect to the vertical direction); U.S. Pat. No. 6,253,429 (disclosing a system where the fabric moves on a series of rotating drums, with manifolds placed at different angles with respect to the fabric); and U.S. Pat. No. 6,557,223 (disclosing moving the fabric transversely over a drum, combined with oscillating manifolds).

Thus, in light of the technical problems inherent in conventional hydroentanglement systems, there exists a need for an economical and practical system and method that reliably reduces the occurrence and/or magnitude of jet streaks in a nonwoven textile product.

SUMMARY OF THE INVENTION

The embodiments of the present invention satisfy the needs listed above and provide other advantages as described below. Embodiments of the present invention may include a system for hydroentangling a sheet of fabric material moving in a processing direction to form a nonwoven fabric. Specifically, in some embodiments, the system comprises an elongate hydroentangling jet strip comprising a plurality of nozzle orifices, wherein each of the plurality of nozzle orifices may be operatively positioned to direct a stream of hydroentangling fluid toward the sheet of fabric material. The plurality of nozzle orifices comprise a first row of nozzle orifices spaced apart along the width of the elongate hydroentangling jet strip. Furthermore, each of the nozzle orifices in the first row of nozzle orifices has a first diameter.

The plurality of nozzle orifices further comprise a second row of nozzle orifices disposed downstream from the first row of nozzle orifices in the processing direction. In some system embodiments, the second plurality of orifices may be spaced apart (i.e. disposed downstream) from the first plurality of orifices in the processing direction at a distance of about one half of the distance between each center of an adjacent pair of the first plurality of orifices. The second row of nozzle orifices are also spaced apart along the width of the elongate hydroentangling jet strip, but are offset at a selected distance from the first row of nozzle orifices along the width of the elongate hydroentangling jet strip. Furthermore, each of the nozzle orifices of the second row of nozzle orifices has a second diameter being smaller than the first diameter. As described herein, the streams of hydroentangling fluid exiting the first row of nozzle orifices create ridges (also known as "jet streaks") in the sheet of fabric material. According to the various embodiments of the present invention, the second row of nozzle orifices are operatively positioned such that the streams of hydroentangling fluid exiting the second row of nozzle orifices reduces a height of the ridges and thereby reduces the incidence of "jet streaks" in the finished nonwoven fabric.

According to various system embodiments of the present invention, the first and second diameters (corresponding to the first and second row of nozzle orifices, respectively) may be provided in a variety of diameters and/or diameter relationships. For example, such embodiments may include, but are not limited to: embodiments wherein the second diameter is at least about 30% of the first diameter; embodiments wherein the second diameter is at least about 50% of the first diameter; embodiments wherein the second diameter is at least about 65% of the first diameter; embodiments wherein the second diameter is no more than about 95% of the first diameter; embodiments wherein the second diameter is no more than about 90% of the first diameter; and embodiments wherein the second diameter is no more than about 85% of the first diameter. Various system embodiments may also provide first and second rows of nozzle orifices wherein the orifices are defined by selected optimized diameters. For example, such embodiments may include, but are not limited to: embodiments wherein the first diameter is between about 120 μm and 160 μm and the second diameter is between about 80 μm and 140 μm; embodiments wherein the first diameter is about 130 μm and the second diameter is about 110 μm; and embodiments wherein the first diameter is about 110 μm and the second diameter is about 90 μm.

According to some system embodiments, the second row of nozzle orifices may be offset at the selected distance from the first plurality of orifices such that a center of each of the second row of nozzle orifices is substantially equidistant between the centers of the closest pair of nozzle orifices of the first row. In other embodiments, the selected distance (which, as described herein, determines the offset of the second row of nozzle orifices) may be measured along the width of the elongate hydroentangling jet strip from a center of at least one of the first row of nozzle orifices to a line extending in the processing direction from a center of a nearest one of the second row of nozzle orifices. More particularly, in some embodiments, the selected distance may be substantially equivalent to a distance defined between a first line extending through the centers of each of the first row of nozzle orifices and a second line extending through the centers of each of the second row of nozzle orifices. In some embodiments, the selected distance may comprise a value that may include, but is not limited to: a selected distance that is greater than or equal to a sum of one half of the first diameter and one half of the second diameter; a selected distance that is greater than or equal to the first diameter; and a selected distance that is greater than or equal to a sum of the first diameter and the second diameter.

Furthermore, in some system embodiments, the plurality of nozzle orifices may further comprise a plurality of rows of nozzle orifices disposed downstream from the second row of nozzle orifices in the processing direction. As described further herein, each of the plurality of rows of nozzle orifices may also be spaced apart along the width of the elongate hydroentangling jet strip. Furthermore each of the successive plurality of rows of nozzle orifices may be offset at a selected distance from the upstream row of nozzle orifices along the width of the elongate hydroentangling jet strip. Furthermore, each of the nozzle orifices of the plurality of rows may have a third diameter that is less than or equal to the second diameter.

Various embodiments of the present invention may also provide methods for hydroentangling a sheet of fabric material moving in a processing direction to form a nonwoven fabric. In some embodiments, the method comprises advancing the fabric material in the processing direction and subjecting the fabric material to a first plurality of fluid streams. The first plurality of fluid streams are spaced apart from one another along a width of the fabric material substantially perpendicular to the processing direction. Furthermore, the first plurality of fluid streams are configured for impacting the fabric material with a first force intensity to form the nonwoven fabric having a plurality of ridges extending along a length of the nonwoven fabric between each of the first plurality of fluid streams. Various method embodiments may further comprise subjecting the nonwoven fabric to a second plurality of fluid streams. The second plurality of fluid streams are disposed downstream from the first plurality of fluid streams in the processing direction and are offset at a selected distance from the first plurality of fluid streams along the width of the fabric material. Thus, according to such embodiments, the second plurality of fluid streams may impact the plurality of ridges with a second force intensity less than the first force intensity, so as to at least partially reduce a height of each of the plurality of ridges in the nonwoven fabric.

As described generally herein with respect to various system embodiments of the present invention, subjecting the fabric material to the first plurality of fluid streams may further comprise forcing a fluid through a first plurality of orifices defined in an elongate hydroentangling jet strip extending across the width of the fabric material. Furthermore, subjecting the nonwoven fabric to a second plurality of fluid streams may comprise forcing the fluid through a second plurality of nozzle orifices defined in the elongate hydroentangling jet strip and offset at the selected distance from the first plurality of orifices along the width of the elongate hydroentangling jet strip. According to some such embodiments, the each of the first plurality of orifices include a first diameter and wherein each of the second plurality of orifices include a second diameter being smaller than the first diameter. Various method embodiments may utilize particular relationships between the first and second diameters as noted above in order to generate fluid streams having the first and second force intensities, respectively.

Thus the various embodiments of the present invention provide many advantages that may include, but are not limited to: providing a system and method for hydroentangling a fabric material to form a nonwoven fabric having a reduced incidence of ridges and/or jet streaks formed therein; providing a system and method for hydroentangling a fabric material to form a nonwoven fabric having an improved toughness and/or tear strength; and providing a system and method for hydroentangling a fabric material to form a nonwoven fabric having a generally smoother texture across a width of the nonwoven fabric.

These advantages, and others that will be evident to those skilled in the art, are provided in the various system and method embodiments of the present invention.

BRIEF DESCRIPTION OF THE DRAWINGS

Figure 1A:
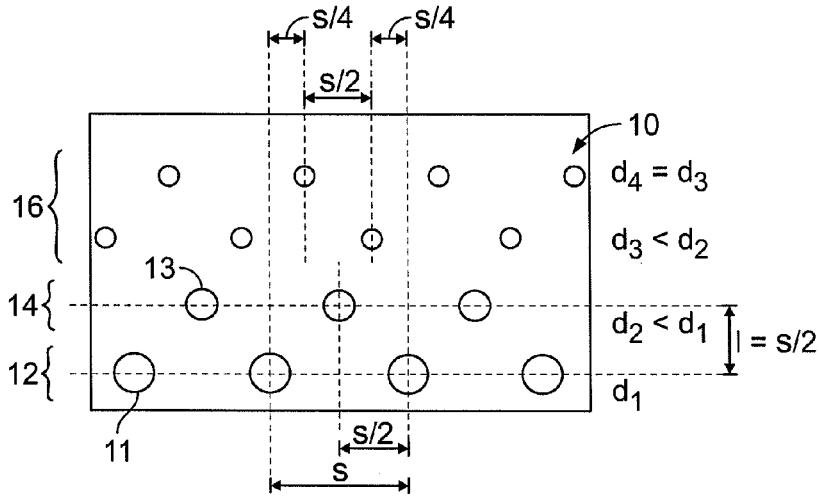
Figure 1B:
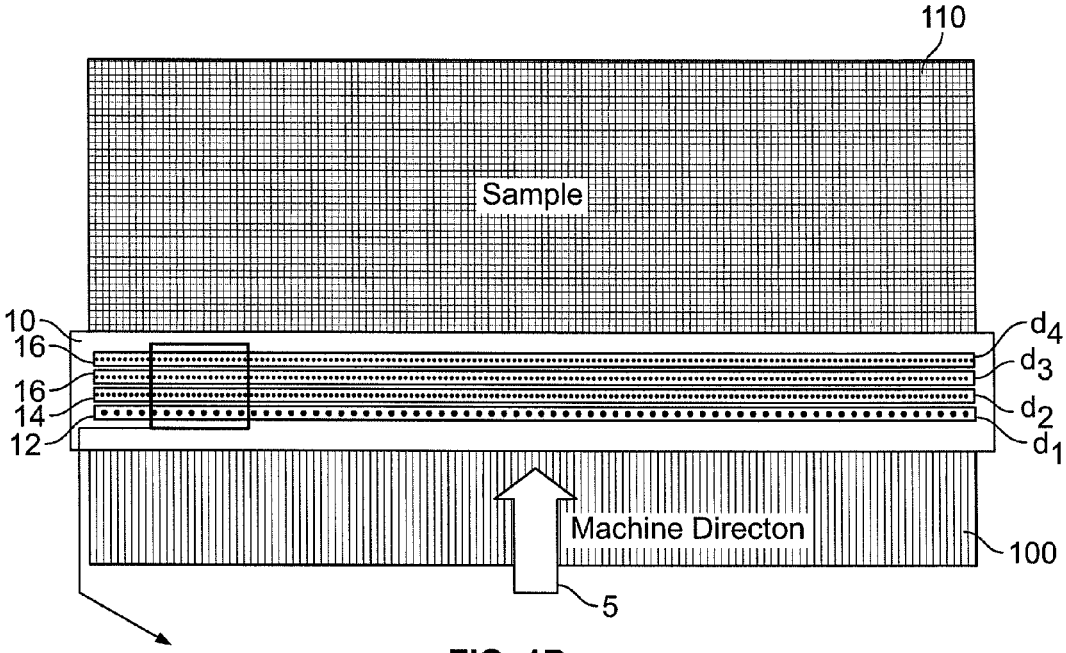
Figure 2:
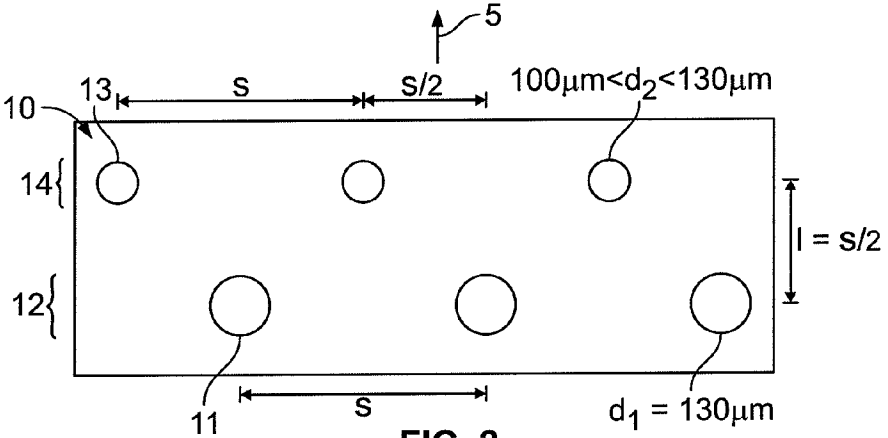
Figure 3:
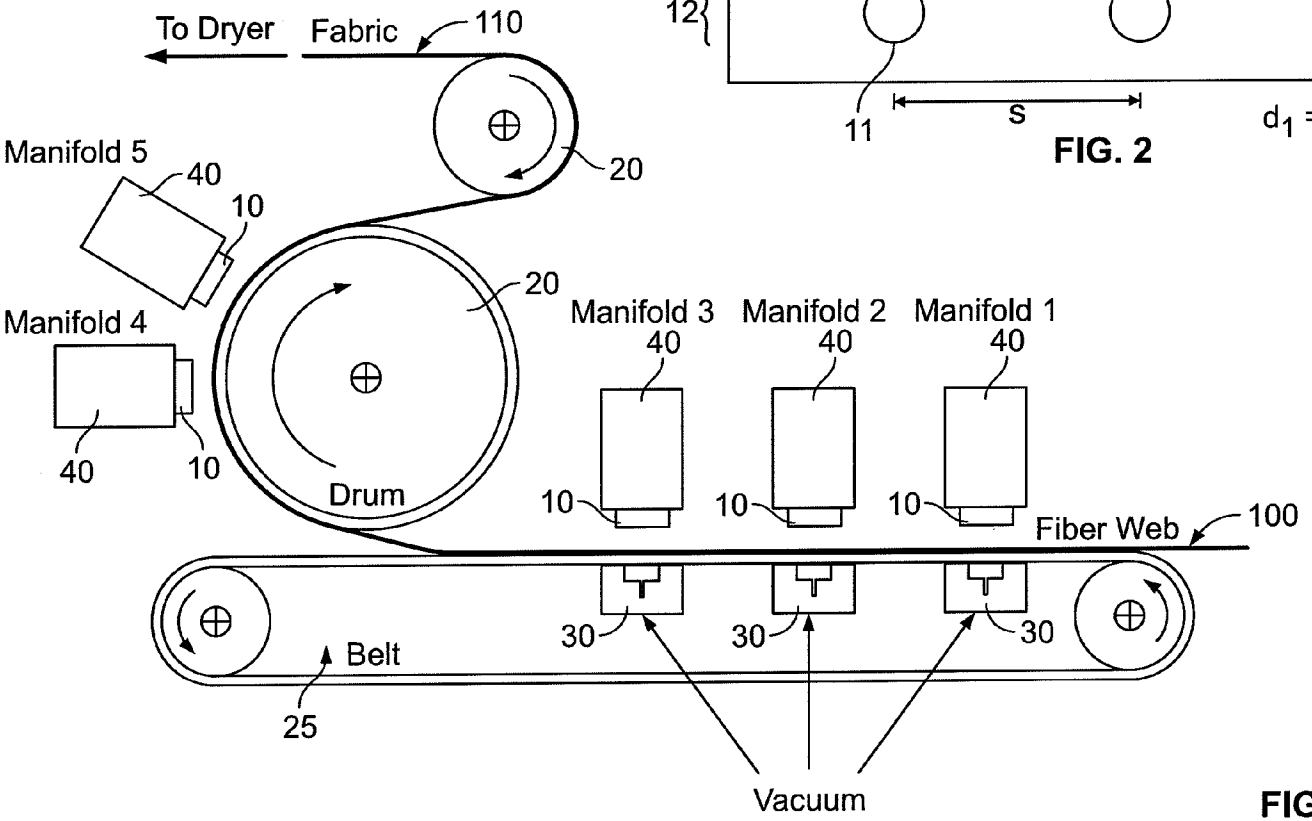
Figure 4:
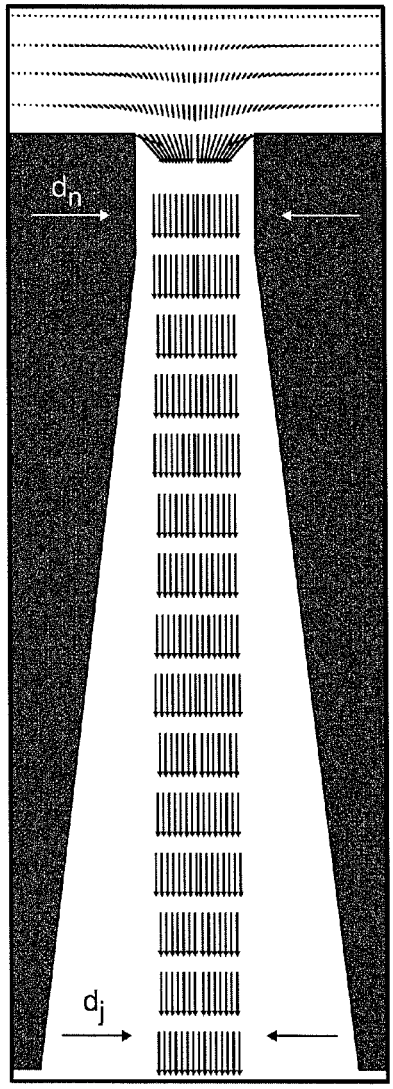
Figures 5A, 5B:
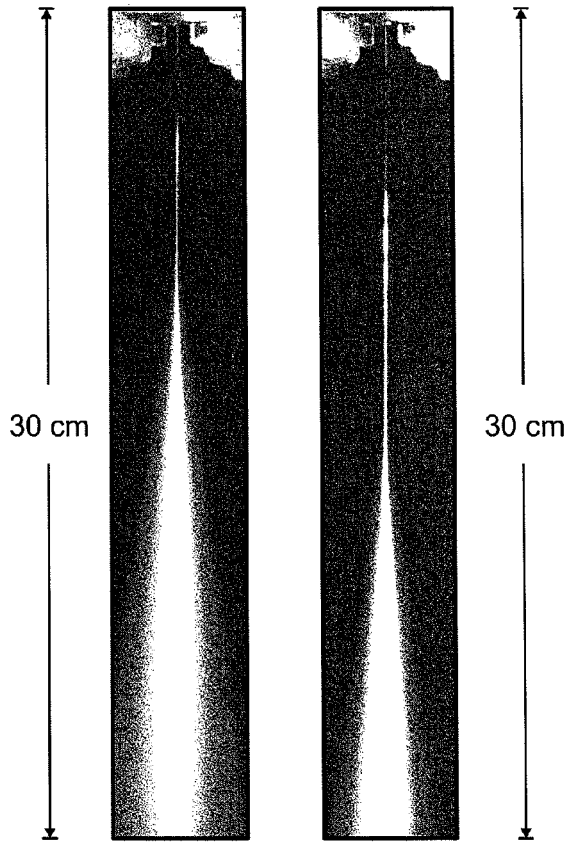
Figure 6:
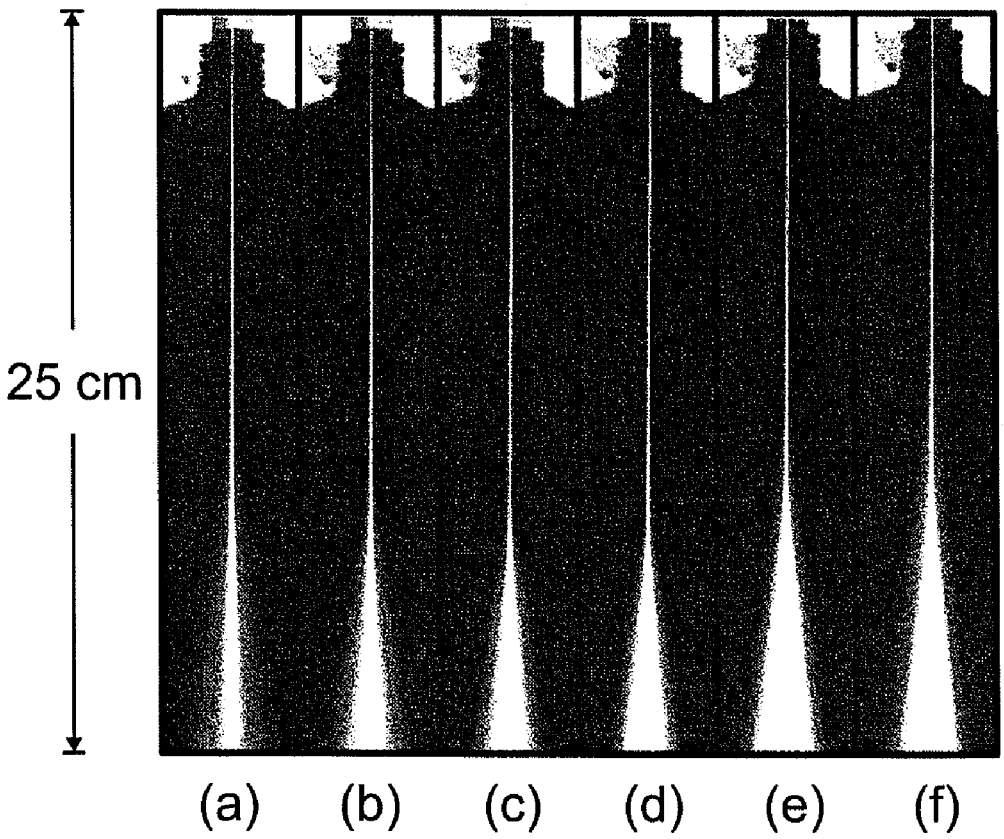
Figure 7:
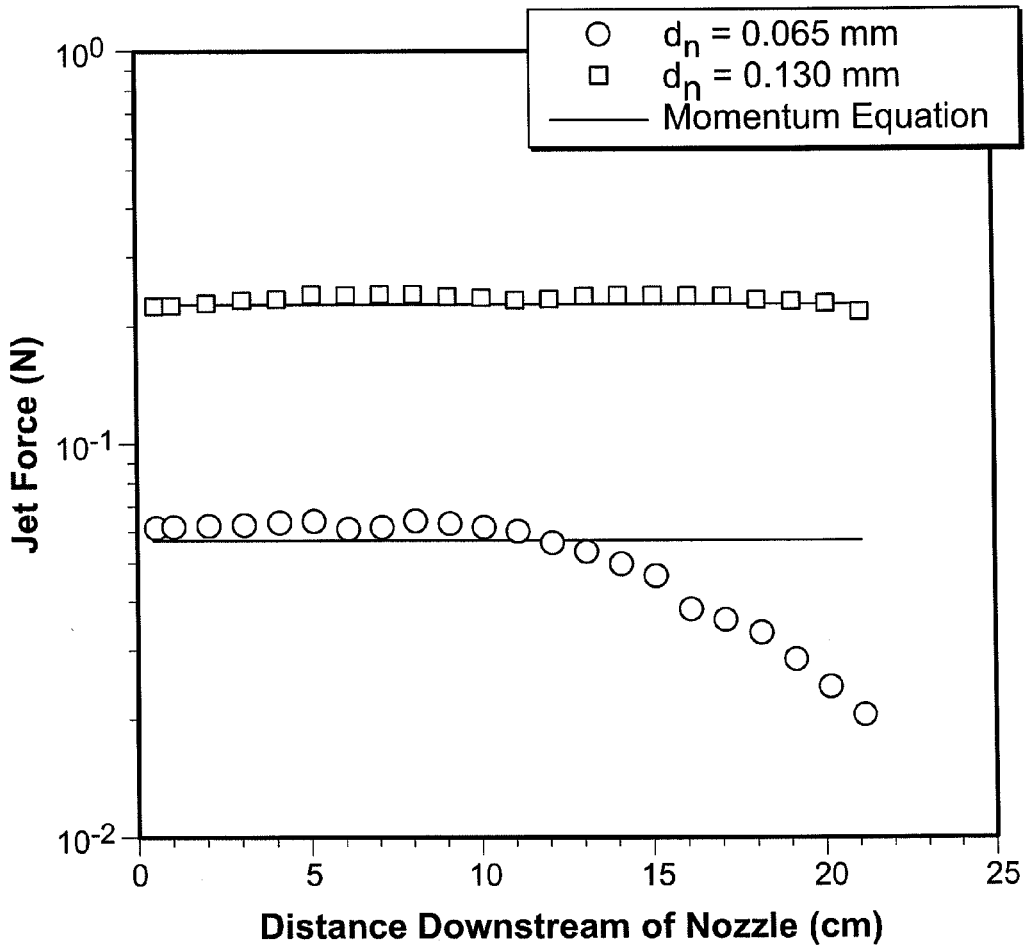
Figure 8A:
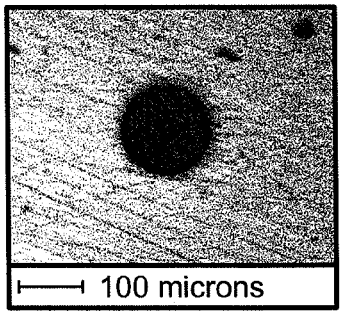
Figure 8B:
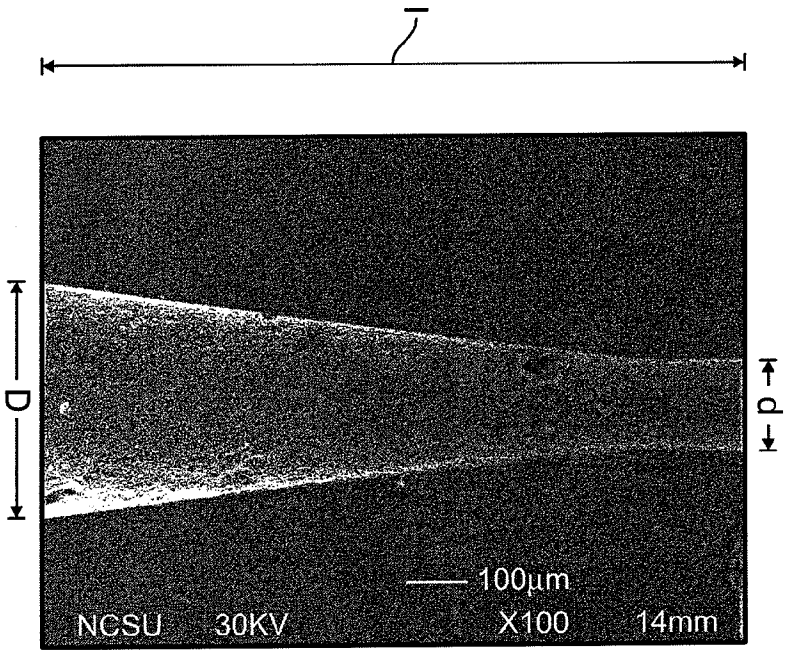
Figure 8C:
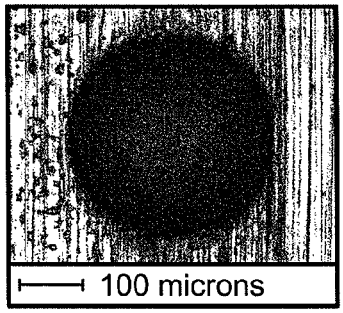
Figure 9:
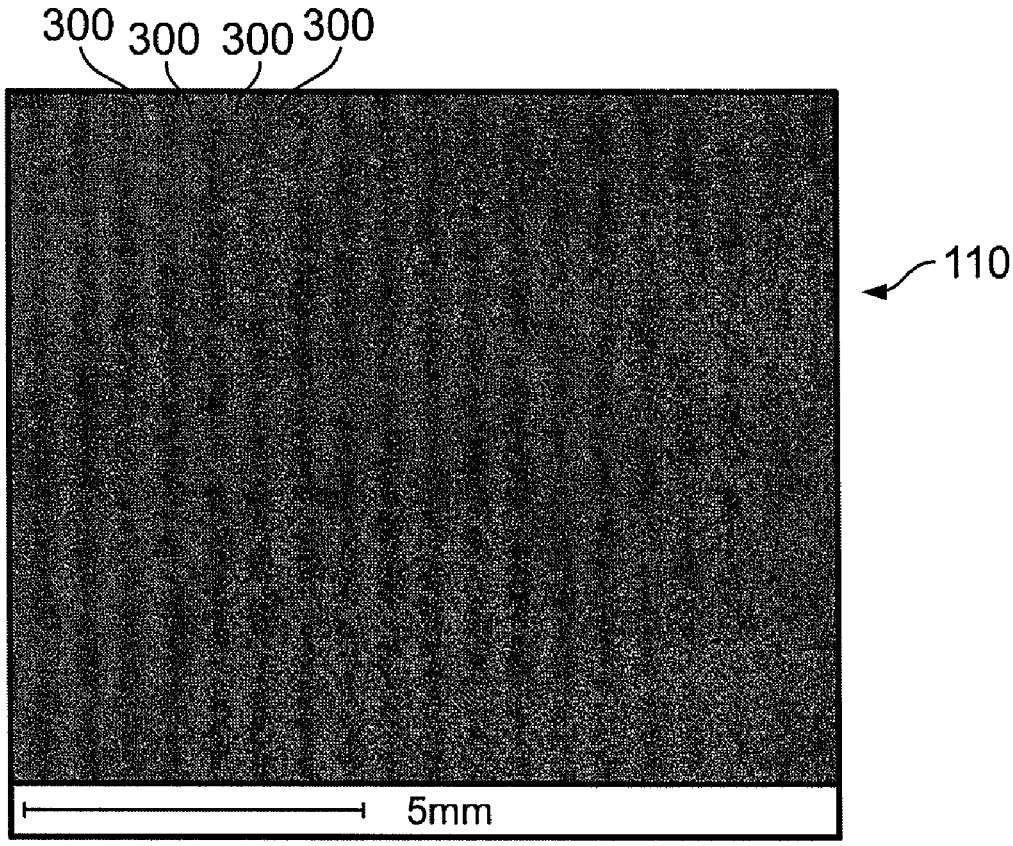
FIG. 9 (Prior Art)
Figure 10A:
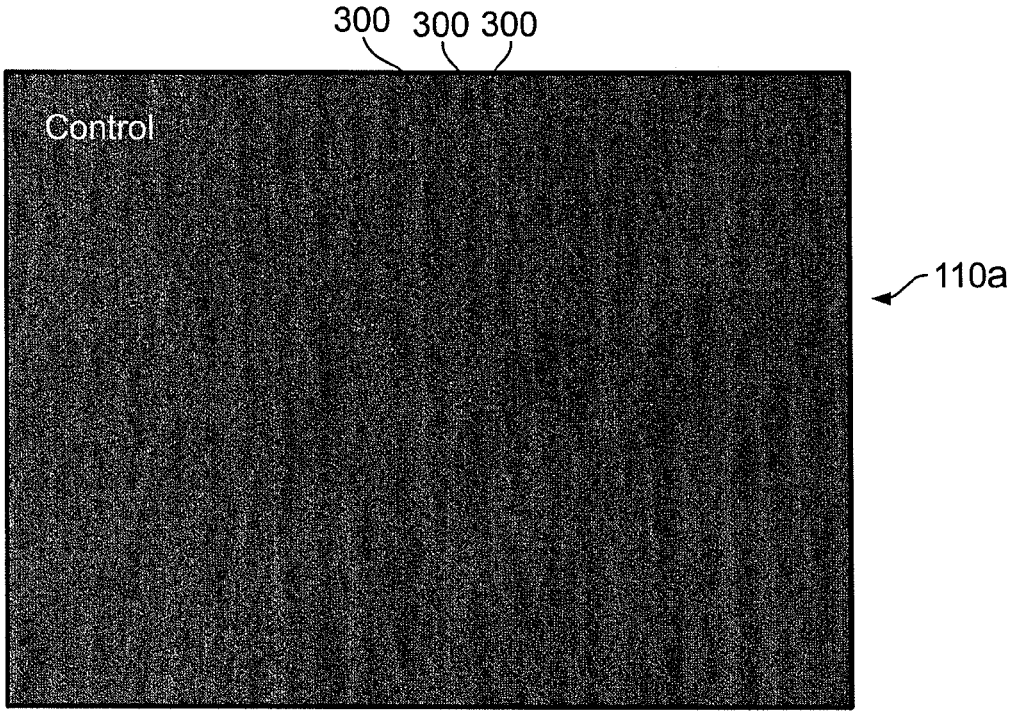
Figure 10B:
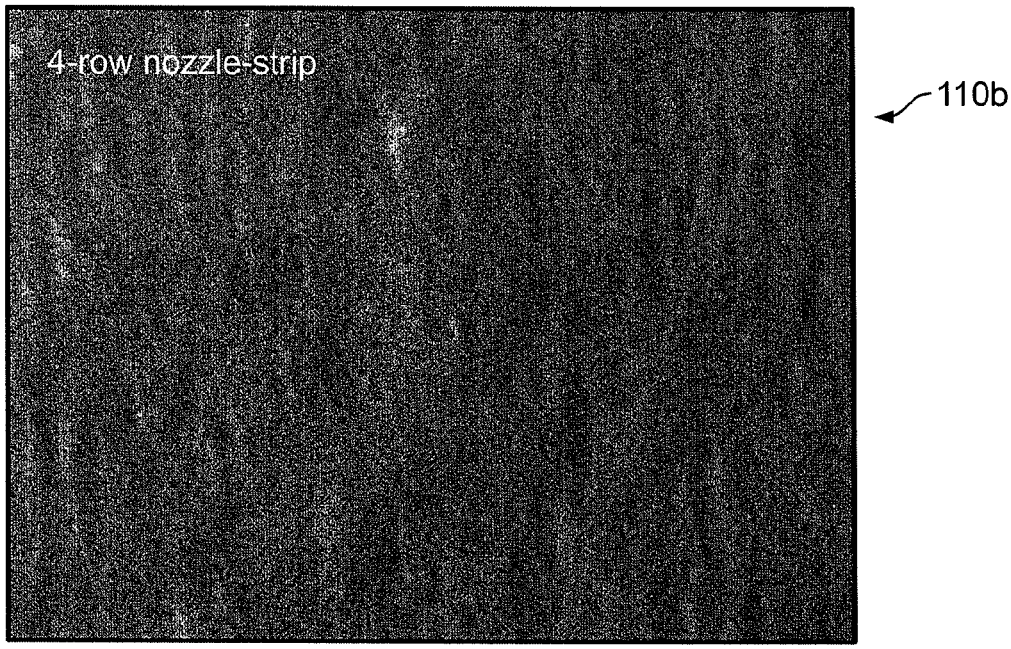
Figure 11A:
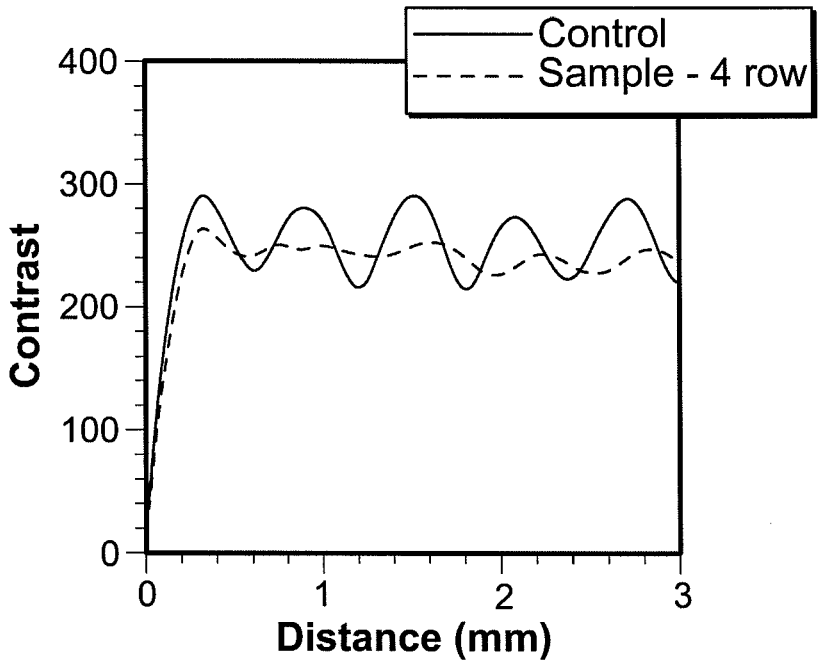
Figure 11B:
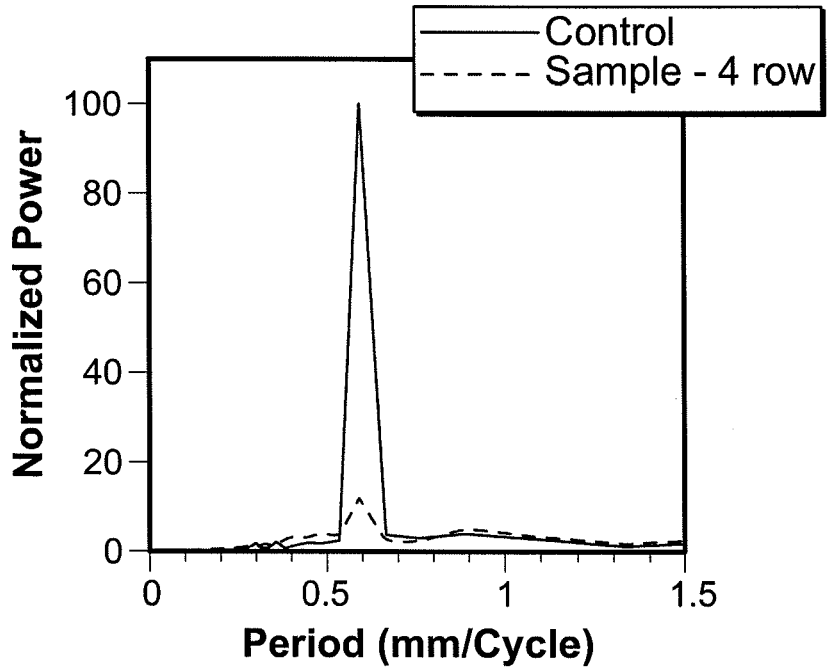
Figure 12A:
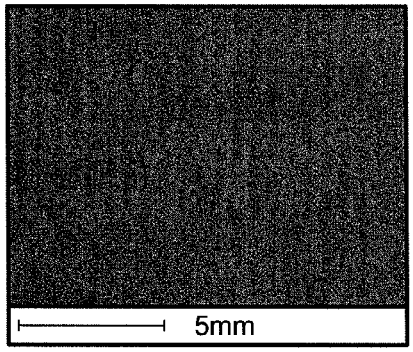
Figure 12B:
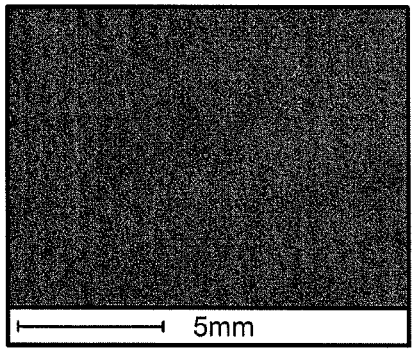
Figure 12C:
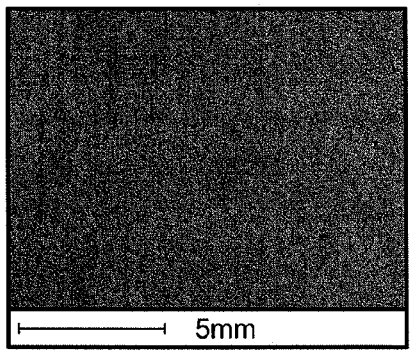
Figure 12D:
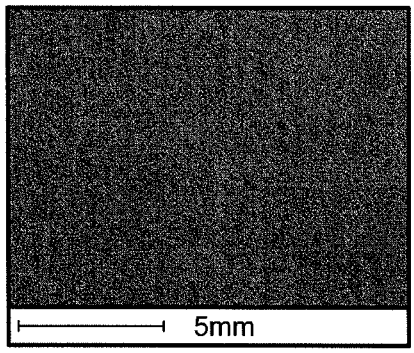
Figure 12E:
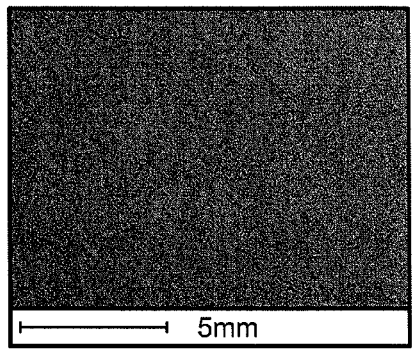
Figure 13A:
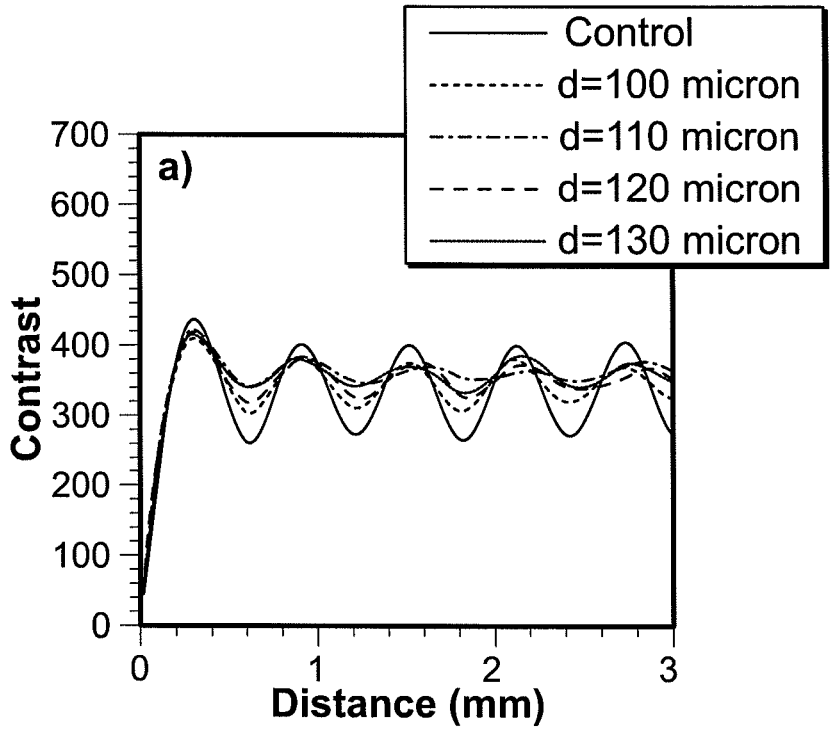
Figure 13B:
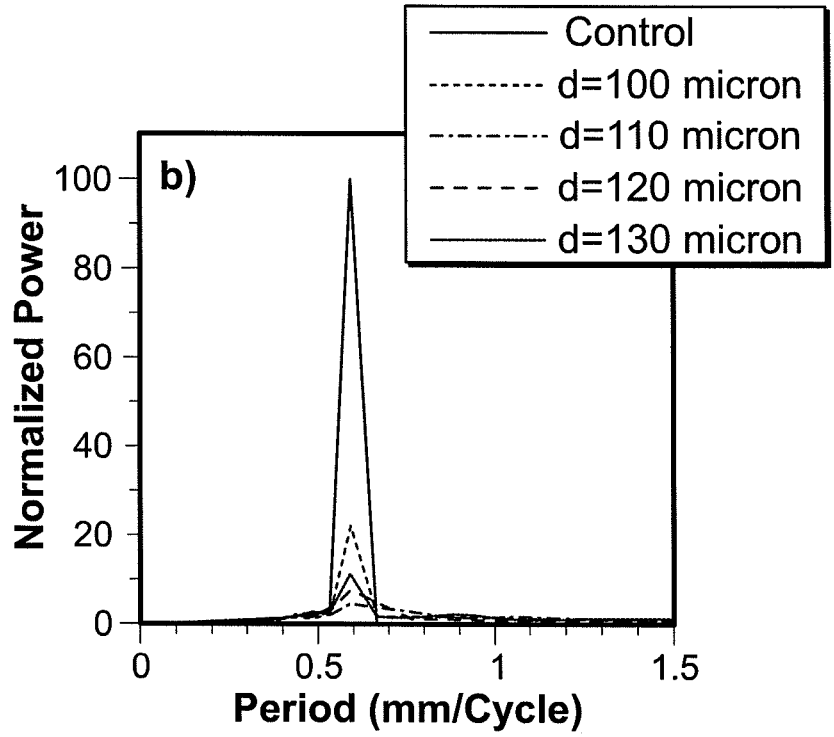
Figure 14A:
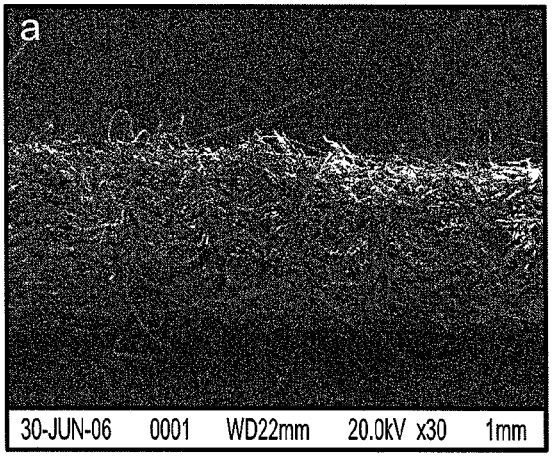
Figure 14C:
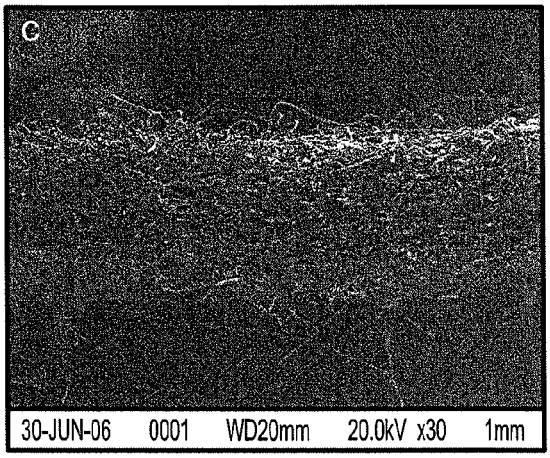
Figure 14B:
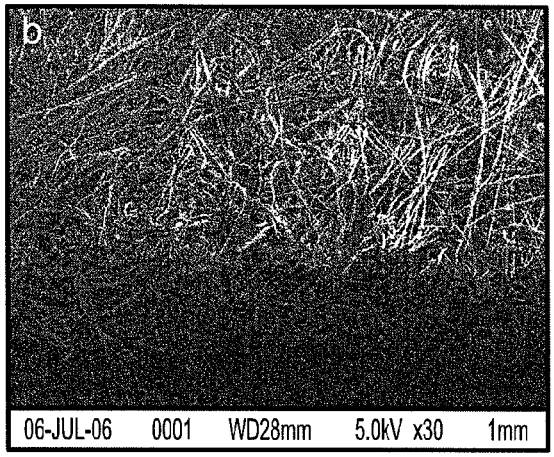
Figure 14D:
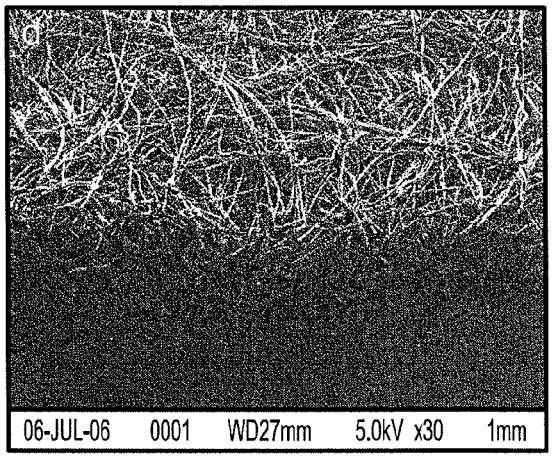
Figures 15A, 15B:
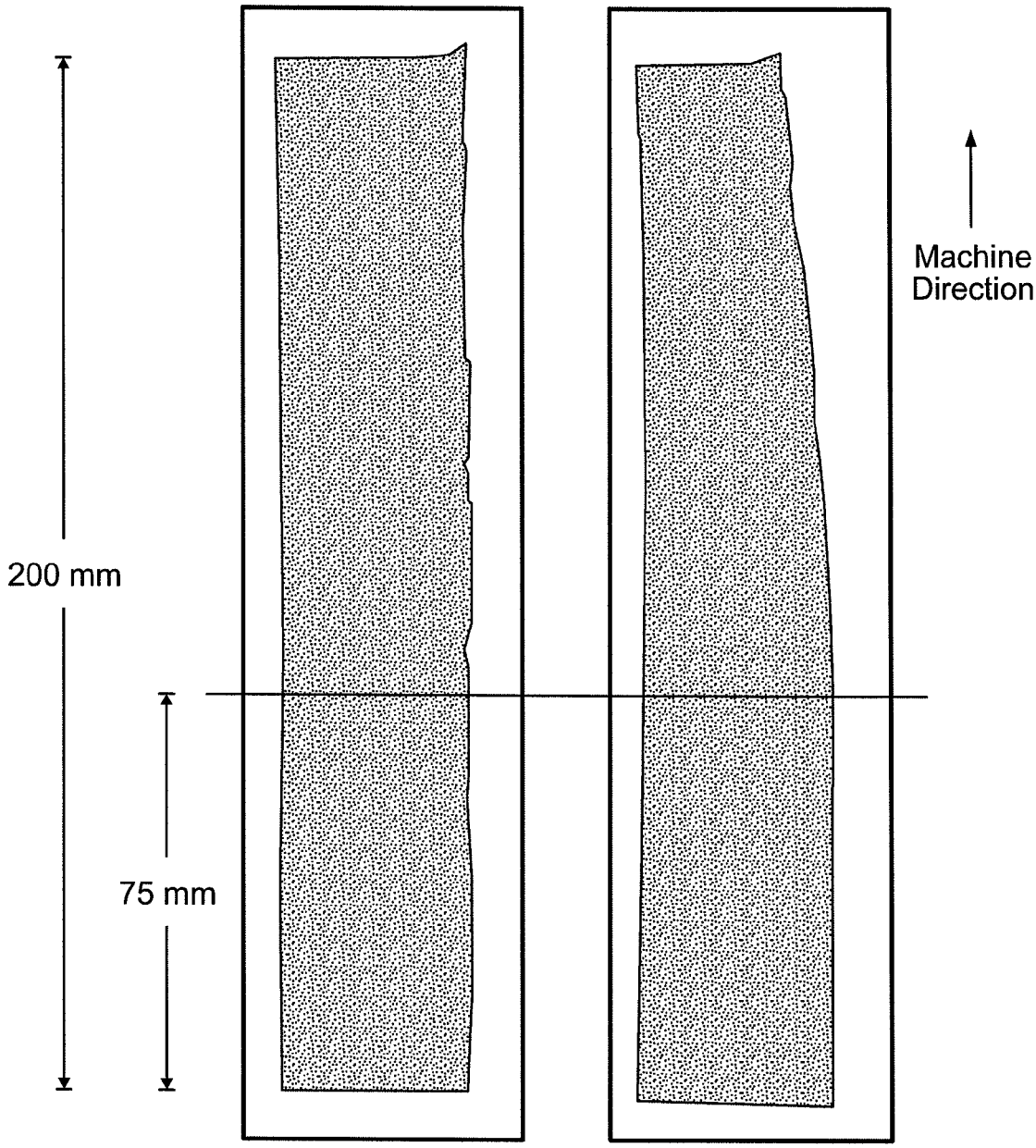
Figure 16:
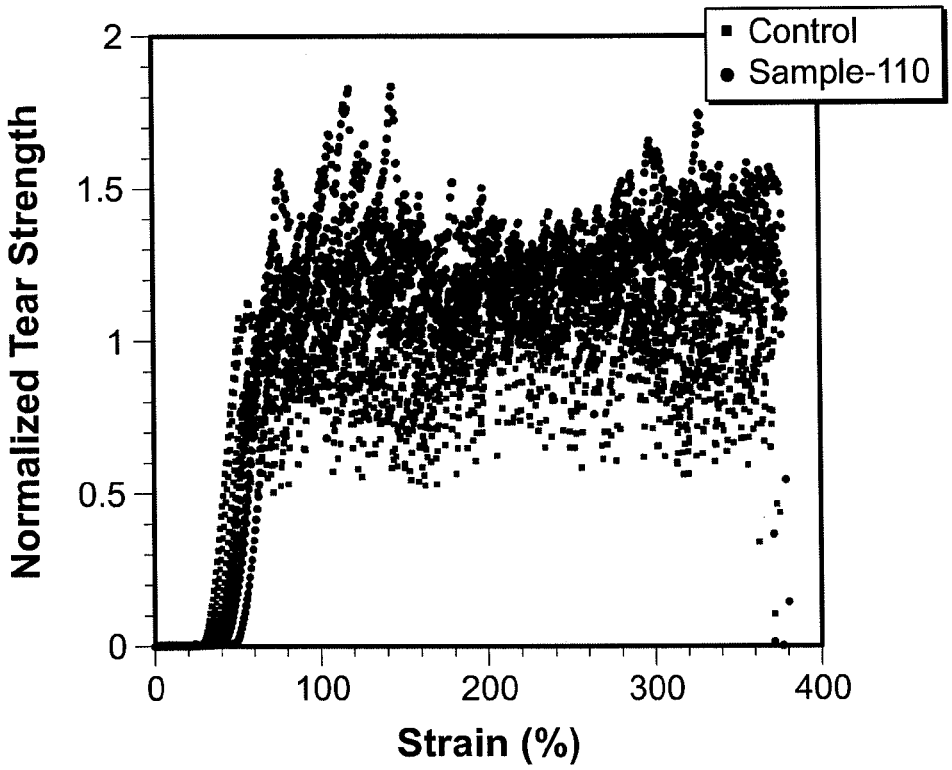
Figure 17:
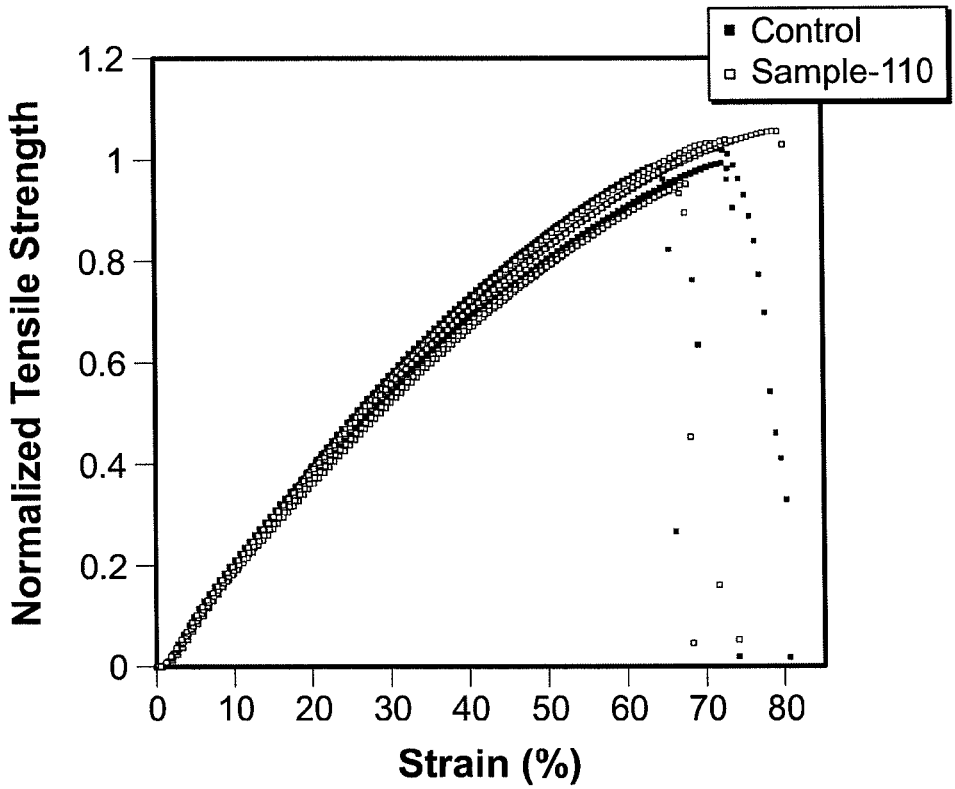

Having thus described the invention in general terms, reference will now be made to the accompanying drawings, which are not necessarily drawn to scale, and wherein:

FIGS. 1A-1B show non-limiting top-view schematics of a system for hydroentangling a sheet of fabric material moving in a processing direction to form a nonwoven fabric, according to one embodiment of the present invention;

FIG. 2 shows non-limiting schematic of an elongate hydroentangling jet strip comprising a plurality of nozzle orifices, according to one embodiment of the present invention;

FIG. 3 shows a non-limiting schematic of a hydroentangling or "spunlacing" system comprising a plurality of manifolds that may be in fluid communication with a corresponding plurality of hydroentangling jet strips for directing various stream of hydroentangling fluid toward a sheet of fabric material to form a nonwoven fabric, according to one embodiment of the present invention;

FIG. 4 shows a non-limiting schematic of the flow of an exemplary high-quality fluid stream in a hydroentangling nozzle, wherein the flow is detached from the nozzle's inner walls, according to one embodiment of the present invention;

FIGS. 5A-5B show non-limiting profiles of two different fluid streams issued from two nozzles having inlet diameters of substantially about 65 μm (FIG. 5A) and substantially about 130 μm (FIG. 5B) at a pressure of 100 bars, according to one embodiment of the present invention;

FIGS. 6A-6F show non-limiting profiles of the fluid streams (i.e. "waterjets") generated by an exemplary hydroentangling nozzle orifice with a diameter of 130 μm at various pressures including: a) 35 bars, b) 70 bars, c) 100 bars, d) 135 bars, e) 170 bars, and f) 200 bars;

FIG. 7 shows a non-limiting plot of impact force intensities imparted by fluid streams (i.e. "waterjets" generated by nozzle orifices with 65 μm and 130 μm diameters, respectively, at a pressure of 100 bars, according to one embodiment of the present invention;

FIGS. 8A-8C show non-limiting scanning electron microscope (SEM) images of a hydroentangling nozzle having an inlet (FIG. 8A) diameter of substantially about 130 μm;

FIG. 9 shows a non-limiting photograph of a hydroentangled fabric having visible ridges and/or jet streaks on its surface that may be formed by a conventional hydroentanglement system;

FIGS. 10A-10B show non-limiting images of: a control nonwoven fabric (FIG. 10A) (produced using conventional hydroentangling systems); and a sample nonwoven fabric (FIG. 10B) (produced using one of the various system and method embodiments of the present invention);

FIGS. 11A-11B show non-limiting co-occurrence curves (FIG. 11A) and periodicity curves (FIG. 11B) corresponding to the control and sample nonwoven fabrics shown in FIGS. 10A-10B, wherein the power values are normalized with that of the control nonwoven fabric;

FIGS. 12A-12E show non-limiting images of a control nonwoven fabric (FIG. 12A) (produced using conventional hydroentangling systems); sample nonwoven fabric 100 (FIG. 12B); sample nonwoven fabric 110 (FIG. 12C); sample nonwoven fabric 120 (FIG. 12D); and sample nonwoven fabric 130 (FIG. 12E), wherein each of the sample nonwoven fabrics where produced using one of the various system and method embodiments of the present invention;

FIGS. 13A-13B show non-limiting: co-occurrence curves (FIG. 13A); and periodicity curves (FIG. 13B) of the Control nonwoven fabric and sample nonwoven fabric 100, sample nonwoven fabric 110, sample nonwoven fabric 120, and sample nonwoven fabric 130, wherein the power values are normalized with that of the control nonwoven fabric;

FIGS. 14A-14D show non-limiting SEM images of 'control nonwoven fabric' and 'sample nonwoven fabric' at a magnification of 30×, where in FIGS. 14A and 14B a cross-sectional and isometric views of 'control nonwoven fabric' are shown, respectively, and where in FIGS. 14C and 14D cross-sectional and isometric views of 'sample nonwoven fabric' are shown, respectively;

FIGS. 15A-15B show non-limiting images of the control nonwoven fabric (FIG. 15A) and sample nonwoven fabric 110 (FIG. 15B) after a tear test in the processing direction;

FIG. 16 shows non-limiting plots of normalized tear strength results versus strain for five replications of the control nonwoven fabric and sample nonwoven fabric 110, wherein the data are normalized with the average tear resistance of the control nonwoven fabric; and FIG. 17 shows non-limiting plots of normalized tensile strength results versus strain for five replications of the control nonwoven fabric and the sample nonwoven fabric 110, wherein the results are normalized using the average maximum tensile resistance of the control nonwoven fabrics.

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

It should be understood that the various embodiments of the present invention provide an advantageous design for elongate hydroentangling jet strips (see element 10, FIGS. 1A, 1B and 2, for example) wherein nozzle orifices are arranged in two or more rows 12, 14 (for example) and configured for minimizing ridges 300 (i.e. "jet-streaks") in a finished nonwoven fabric 110. In some embodiments, the nozzle in each row 12, 14 may have a fixed capillary diameter (d1, for example, as shown in FIG. 2). As described further herein, these diameters decrease from a first row of nozzle orifices 12 (the row that creates fluid streams that impact the fabric material 100 first) to the third and fourth row 16 (see FIG. 1A, for example) (the rows that impact the fabric material 100 last) (i.e., d1>d2>d3=d4, for example) where d1 to d4 represents the capillary diameter of the nozzles in the first to fourth rows, respectively.

It should further be understood that the individual nozzles forming the rows of nozzle orifices 12, 14, 16 may, in various embodiments, be configured in a "cone-down" (see generally, FIG. 8B and FIG. 4, for example) or cone-up position, and are preferably arranged in a "staggered" configuration as shown generally in FIG. 1A. It has been experimentally observed that ridges 300 (and/or "jet-streaks") are re-formed in hydroentanglement processes every time the fabric material 100 is impacted by a particular "curtain" of fluid streams generated by a corresponding row of nozzle orifices (see element 12, for example). Consequently, the ridges 300 that may be apparent in a finished nonwoven fabric 110 may be caused by the final manifold 40 in a hydroentanglement system (see, for example, Manifold 5, FIG. 3). This result is especially apparent in conventional processes wherein the final manifold operates at a higher pressure than those of "upstream" manifolds (and thereby creates fluid streams that impact the fabric material 100 with the highest force). Therefore, the various system and method embodiments of the present invention may be used in conjunction with one or more manifolds disposed in a substantially "downstream" position (i.e. further along the processing direction 5 (as shown in FIG. 1B, for example)) that cooperate with an elongate hydroentangling jet strip 10 to create fluid streams.

The various hydroentanglement system and method embodiments described herein provide an elongate hydroentangling jet strip 10 defining a first row of nozzle orifices 12 that generate corresponding fluid streams that create a set of ridges 300 and valleys (co-located with the fluid streams, for example). Furthermore, as described further herein, fluid streams created by a second row of nozzle orifices 14 (having a smaller nozzle orifice diameter and arranged in a staggered "offset" configuration (as shown in FIGS. 1A, 1B and 2, for example) will impact the "peaks" of the ridges 300 formed by the fluid streams of the first row of nozzle orifices 12. It should be understood that nozzle orifices having smaller diameters will alleviate the primary ridges 300 without creating any new noticeable streaks (see, for example, the co-occurrence analysis results presented in the Experimental Example herein and as shown, for example, in FIGS. 11A, 11B, 13A and 13B. Furthermore, other embodiments (such as those shown generally in FIG. 1A), may comprise a third and fourth row of nozzle orifices 16 having diameters smaller than those nozzle orifices in the second row of nozzle orifices 14 and may further diminish the already-reduced ridges 300 and/or jet-streaks that may result from the second row of nozzle orifices 14.

As shown in FIG. 1B, some embodiments provide a system for hydroentangling a sheet of fabric material 100 moving in a processing direction 5 to form a nonwoven fabric 110. As shown in FIG. 1A, the system comprises an elongate hydroentangling jet strip 10 comprising a plurality of nozzle orifice rows 12, 14, 16, each nozzle orifice operatively positioned to direct a stream of hydroentangling fluid (see FIG. 6, generally, showing a plurality of different stream profiles corresponding to a plurality of nozzle configurations) toward the sheet of fabric material 10. As shown in FIG. 2, the plurality of nozzle orifices defined in the elongate hydroentangling jet strip 10 may, in some embodiments, comprise a first row of nozzle orifices 12 spaced apart along the width of the elongate hydroentangling jet strip 10. Each of the nozzle orifices of the first row of nozzle orifices 12 has a first diameter d1. The plurality of nozzle orifices also comprise a second row of nozzle orifices 14 disposed downstream from the first row of nozzle orifices 12 in the processing direction 5. The second row of nozzle orifices 14 may also be spaced apart along the width of the elongate hydroentangling jet strip 10. Furthermore, as shown in FIG. 2, the second row of nozzle orifices 14 may be offset at a selected distance (S/2, for example) from the first row of nozzle orifices 12 along the width of the elongate hydroentangling jet strip 10, meaning that the center of each nozzle orifice of the second row is offset laterally along the width of the hydroentangling jet strip as compared to the center of each nozzle orifice of the first row. In other words, a line drawn through the center of a nozzle orifice of the second row 14 that is parallel to the processing direction will be laterally offset by a selected distance from a similar line drawn through the center of the closest nozzle orifice of the first row 12. Furthermore, each of the second row of nozzle orifices 14 has a second diameter d2 being smaller than the first diameter d1.

As described herein with respect to various conventional hydroentangling systems, streams of hydroentangling fluid (see FIG. 6, for example) exiting the first row of nozzle orifices 12 may create ridges 300 in the sheet of fabric material 100 during processing. However, according to various embodiments of the present invention, the second row of nozzle orifices 14 may be operatively positioned (at an offset characterized by a selected distance S/2, for example) such that the streams of hydroentangling fluid exiting the second row of nozzle orifices 14 reduces a height of the ridges 300. For example, FIGS. 10A-10B show a control nonwoven fabric 110*a* (which exhibits a plurality of ridges 300 therein) in comparison to a sample nonwoven fabric 110*b* produced, for example, using one or more system embodiments of the present invention.

In some system embodiments, as shown generally in FIG. 2, the second row of nozzle orifices 14 may be offset at the selected distance S/2 from the first plurality of orifices 12 such that a center of each of the second row of nozzle orifices 14 is substantially equidistant from a center of each of a pair of nozzle orifices of the first row 12 positioned closest to each of the second row of nozzle orifices 14. Thus, according to such embodiments, if the distance between the respective centers of a pair of adjacent nozzle orifices in the first row of nozzle orifices 12 is characterized as distance S the selected distance of the offset of the second row of nozzle orifices 14 may be characterized as selected distance S/2. Furthermore, as shown in FIG. 2, in some embodiments, the second plurality of orifices 14 may be spaced apart from the first plurality of orifices 12 in the processing direction 5 at a distance L of about one half of the distance S between each center of an adjacent pair of the first plurality of orifices 12.

In some additional system embodiments (as shown generally in FIGS. 1A, 1B and 2, the selected distance (S/2, for example) may measured along the width of the elongate hydroentangling jet strip 10 from a center of at least one of the first row of nozzle orifices 12 to a line extending in the processing direction 5 from a center of a nearest one of the second row of nozzle orifices 14. More particularly, in some embodiments the selected distance may be substantially equivalent to a distance defined between a first line extending through the centers of each of the first row of nozzle orifices 12 and a second line extending through the centers of each of the second row of nozzle orifices 14 (as, shown for example, in FIG. 2). In some embodiments the selected distance may be substantially less than or greater than S/2 (wherein S corresponds to a distance between adjacent nozzle orifices, for example). For example, in some embodiments, the selected distance may be greater than or equal to a sum of one half of the first diameter d1 and one half of the second diameter d2, such that a line extending parallel to the processing direction 5 would be tangent to a rightmost extent of one of the first row of nozzle orifices 12 and also tangent to a leftmost extent of one of the second row of nozzle orifices 14. In other system embodiments, the selected distance of offset may include, but is not limited to: greater than or equal to the first diameter d1; and greater than or equal to a sum of the first diameter d1 and the second diameter d2.

As described herein with respect to FIG. 2, for example, each of the first row of nozzle orifices 12 has a first diameter d1 and each of the second row of nozzle orifices 14 has a second diameter d2 that is smaller than the first diameter d1.

The various diameters d1, d2 of the nozzle orifices in the first and second rows 12, 14 of nozzle orifices determine, at least in part, the impact force with which each fluid stream generated by the nozzle orifices impacts the fabric material 100 to form the nonwoven fabric 110. As described further herein, the diameter d2 of the nozzle orifices in the second (and laterally offset) row of nozzle orifices 14 is preferably smaller than the corresponding diameter d1 of the nozzle orifices within the first row or nozzle orifices 12 such that the second row of nozzle orifices 14 may be capable of producing fluid streams that impact the fabric material 100 at the approximate lateral location of the ridges 300 formed, for example, by the first row of nozzle orifices 12 so as to reduce a height and/or amplitude of such ridges 300. As described herein with respect to Equation (2), it can be seen that an impact force of a fluid stream is proportional to the square of the diameter of the corresponding nozzle orifice from which the fluid stream is generated. Furthermore, as discussed herein on, the proportional relationship between nozzle orifice diameter and a resulting fluid stream impact force may be used to optimally level and/or reduce ridges 300 ("jet-streaks") formed on a nonwoven fabric's 110 surface (see for example, FIG. 10A, showing a control nonwoven fabric 110*a* produced using conventional hydroentangling processes (and exhibiting clearly-visible ridges 300 therein) and FIG. 10B showing a nonwoven fabric 110*b* produced using a 4-row system according to one embodiment of the present invention (as shown generally in FIG. 1A)).

In some embodiments, as shown for example in FIG. 2 each of the first row of nozzle orifices 12 may be provided with a diameter d1 of approximately 130 μm and each of the second row of nozzle orifices 14 may be provided with a diameter d2 of between approximately 100 μm and 130 μm. It should be understood that the diameter dimensions d1, d2 shown in FIG. 2 are merely exemplary. In some system embodiments, the first diameter d1 and second diameter d2 be sized using relationships that may include, but are not limited to: embodiments wherein the second diameter d2 is at least about 30% of the first diameter d2; embodiments wherein the second diameter d2 is at least about 50% of the first diameter d1; embodiments wherein the second diameter d2 is at least about 65% of the first diameter d1; embodiments wherein the second diameter d2 is no more than about 95% of the first diameter d1; embodiments wherein the second diameter d2 is no more than about 90% of the first diameter d1; and embodiments wherein the second diameter d2 is no more than about 85% of the first diameter d1. In other system embodiments, the first diameter d1 may be between about 120 μm and 160 μm (including, first diameters d1 of 120 μm, 121 μm, 122 μm, 123 μm, 124 μm, 125 μm, 126 μm, 127 μm, 128 μm, 129 μm, 130 μm, 131 μm, 132 μm, 133 μm, 134 μm, 135 μm, 136 μm, 137 μm, 138 μm, 139 μm, 140 μm, 141 μm, 142 μm, 143 μm, 144 μm, 145 μm, 146 μm, 147 μm, 148 μm, 149 μm, 150 μm, 151 μm, 152 μm, 153 μm, 154 μm, 155 μm, 156 μm, 157 μm, 158 μm, 159 μm, and 160 μm). Furthermore, in some system embodiments, the second diameter d2 may be between about 80 μm and 140 μm (including second diameters d2 of 80 μm, 81 μm, 82 μm, 83 μm, 84 μm, 85 μm, 86 μm, 87 μm, 88 μm, 89 μm, 90 μm, 91 μm, 92 μm, 93 μm, 94 μm, 95 μm, 96 μm, 97 μm, 98 μm, 99 μm, 100 μm, 101 μm, 102 μm, 103 μm, 104 μm, 105 μm, 106 μm, 107 μm, 108 μm, 109 μm, 110 μm, 111 μm, 112 μm, 113 μm, 114 μm, 115 μm, 116 μm, 117 μm, 118 μm, 119 μm, 120 μm, 121 μm, 122 μm, 123 μm, 124 μm, 125 μm, 126 μm, 127 μm, 128 μm, 129 μm, 130 μm, 131 μm, 132 μm, 133 μm, 134 μm, 135 μm, 136 μm, 137 μm, 138 μm, 139 μm, and 140 μm). In other system embodiments, the first diameter d1 may be more preferably about 130 μm and the second diameter d2 may be more preferably about 110 μm. In other system embodiments, the first diameter d1 may be more preferably about 110 μm and the second diameter d2 may be more preferably about 90 μm.

Referring to FIGS. 1A and 1B, in some system embodiments the plurality of nozzle orifices defined in the elongate hydroentangling jet strip 10 may further comprises a plurality of rows of nozzle orifices 16 disposed downstream from the second row of nozzle orifices 14 in the processing direction 5. Each of the nozzle orifices within each of the plurality of rows of nozzle orifices 16 may be spaced apart (by a distance S, for example) along the width of the elongate hydroentangling jet strip 10. Furthermore, each of the plurality of rows of nozzle orifices 16 may be offset at a selected distance (S/2, for example) from the upstream row of nozzle orifices along the width of the elongate hydroentangling jet strip 10. As shown in FIG. 1A, each of the nozzle orifices of the plurality of rows 16 may have diameters d3, d4 that are less than or equal to the second diameter d2. Thus the plurality of rows of nozzle orifices 16 disposed substantially downstream (in the processing direction 5) from the second row of nozzle orifices 14 may produce corresponding fluid streams capable of reducing ridges 300 formed in the fabric material 110 by the immediately previous (i.e. upstream) row of nozzle orifices.

Various embodiments of the present invention also provide methods for hydroentangling a sheet of fabric material 100 moving in a processing direction 5 to form a nonwoven fabric 110. In one embodiment, the method comprises advancing the fabric material 100 in the processing direction 5. As shown generally in FIG. 3, the advancing step may be accomplished using a conveyor belt 25 configured for carrying the fabric material 100. The fabric material 100 (and the nonwoven fabric 100 resulting therefrom, may also be advanced by being taken up on a series of drums 20 that may carry the finished nonwoven fabric 110 to a dryer or other downstream processing step. The method further comprises subjecting the fabric material 100 to a first plurality of fluid streams. As described herein with respect to various system embodiments, the first plurality of fluid streams may be generated by a corresponding first row of nozzle orifices 12 (see FIG. 2). The first plurality of fluid streams may thus be spaced apart from one another along a width of the fabric material 100 substantially perpendicular to the processing direction 5. The first plurality of fluid streams may be configured for impacting the fabric material 100 with a first force intensity to form the nonwoven fabric 110 having a plurality of ridges 300 (see FIG. 9, for example) extending along a length of the nonwoven fabric 110 between each of the first plurality of fluid streams.

The method embodiments of the present invention further comprise subjecting the nonwoven fabric 110 to a second plurality of fluid streams disposed downstream from the first plurality of fluid streams in the processing direction 5. The second plurality of fluid streams are laterally offset at a selected distance from the first plurality of fluid streams along the width of the fabric material 110, such that the second plurality of fluid streams impact the plurality of ridges 300 with a second force intensity less than the first force intensity, so as to at least partially reduce a height of each of the plurality of ridges 300 in the nonwoven fabric 110.

The steps of the various method embodiments described herein may be accomplished, for example, using system embodiments also described herein. For example, in some method embodiments, the step for subjecting the fabric material to the first plurality of fluid streams may further comprise forcing a fluid through a first plurality of orifices 12 defined in an elongate hydroentangling jet strip 10 extending across the width of the fabric material 100 (see, for example, FIG. 2, showing an exemplary elongate hydroentangling jet strip 10). Furthermore, the step for subjecting the nonwoven fabric to a second plurality of fluid streams may comprise forcing the fluid through a second plurality of nozzle orifices 14 defined in the elongate hydroentangling jet strip 10 and offset at the selected distance (see distance S/2, for example, in FIG. 2) from the first plurality of orifices 12 along the width of the elongate hydroentangling jet strip 10. As described above with respect to the various system embodiments of the present invention, the second plurality of nozzle orifices 14 may be operatively positioned (at an offset defined by a selected distance (S/2, for example) relative to the first plurality of nozzle orifices 12 (see FIG. 2) so as to be capable of reducing and/or minimizing the height of various ridges 300 ("jet streaks") formed by fluid streams generated by the first plurality of nozzle orifices 12 (and/or other fluid stream "curtains" disposed substantially upstream (in the processing direction 5) from the first plurality of nozzle orifices 12.

As described herein, various embodiments of the present invention utilize such fluid stream curtains to accomplish the hydroentanglement process. It should be understood that efficient energy transfer from the fluid streams to the surface of the fabric material 100 contributes to efficiency in the overall fiber entanglement process. For an efficient energy transfer, it may be advantageous to provide a nozzle and nozzle orifice capable of producing a "high-quality" fluid stream. In the present context, "high-quality" fluid streams refers generally to a fluid stream that exhibits a relatively long intact length (long breakup length) and/or a fluid stream that remains collimated for the range of manifold pressures that may be used in hydroentangling: 30 to 400 bars, for example (see FIGS. 6A-6F). Such high-quality fluid streams often result from a detached nozzle flow configured for producing "constricted waterjet" that is characterized by substantially laminar flow and an outwardly glassy appearance. To obtain a fluid stream that remains substantially laminar for the required pressure ranges, most wall-induced friction and/or vorticity that perturbs the water flow through the nozzle should be mitigated and/or eliminated. This is possible when the flow inside the nozzle is detached from the nozzle's inner walls (see FIG. 4). Such detachment may be achieved when the flow of fluid is forced to make a sudden 90-degree turn when entering the nozzle defined in the hydroentangling jet strip 10. Note that non-constricted fluid streams at the operating pressure ranges may quickly turn into spray once they exit the nozzle orifice such that their energy is readily dispersed.

According to various embodiments of the present invention, the nozzle orifices making up the various rows of nozzle orifices 12, 14, 16 may be in fluid communication with nozzles defined in the hydroentangling jet strip 10 (see, for example, the nozzle cross-section shown in FIG. 8B) that are configured for producing "constricted fluid streams" that result in high-quality and/or highly collimated fluid streams (such as those depicted, for example, in FIGS. 6A-6F). In some such embodiments, the nozzle may comprise nozzle configurations such as those disclosed in U.S. Patent Publication No. 2006-0124772, entitled *Hydroentangling Jet Strip Device Defining An Orifice*, which is hereby incorporated by reference herein in its entirety.

Furthermore, it should be noted that the diameter of constricted fluid streams, $d_j$ may be expressed as:

$$d_j=\sqrt{C_d}d_n \tag{1}$$

where $C_d \cong 0.62$ is the discharge coefficient of preferably sharp-edge capillary nozzles that generate constricted fluid stream and $d_n$ is the nozzle inlet diameter. The most conventionally used nozzle inlet diameter, $d_n$ is 130 μm resulting in a fluid stream of about 100 μm diameter (see FIG. 5, for example). As mentioned above, high-quality hydroentangling fluid streams may be generated with relatively long breakup lengths. Diameter of the fluid streams at the moment when they hit the fabric material 100, (about 5 cm from the exit of the nozzle orifice, for example), is nearly the same as what it was at the exit plane of the nozzle orifice, $d_j=\sqrt{C_d}d_n$. The impact force, F of a fluid stream may be linearly proportional to its velocity, V and flow rate, $\dot{m}$ for as long as it is not broken up into a spray.

$$F \propto \dot{m}V \tag{2}$$

where $\dot{m}=\pi/4\rho d_j^2 V$. Note that the velocity of a constricted fluid stream can be calculated from its stagnation pressure via Bernoulli's equation, $V=\sqrt{2}p^{1/2}\rho^{-1/2}$, with sufficient accuracy. Here p and ρ are the manifold's gauge pressure and the liquid's density, respectively. From Equation (2), it can be seen that impact force imparted by a fluid stream is proportional to the square of its diameter (and thereby proportional to the square of the diameter of the nozzle orifice). As discussed herein, this relationship between fluid stream impact force and fluid stream diameter may be used to reduce the heights of ridges 300 formed on a surface of a hydroentangled nonwoven fabric 110. In particular, various embodiments of the present invention are configured to produce a series of fluid stream curtains comprising fluid streams having successively smaller diameters that impact the ridges 300 forming the jet-streaks.

However, it should be noted that reducing the diameter of the nozzle orifice (and the resulting fluid stream) may result in the formation of fluid streams with shorter breakup lengths. As discussed herein, the intact length of the jets should be, in some embodiments, at least 5 cm in order to reach the fabric material 100 before break up. Therefore, to examine the range of diameters that may be used to design an effective hydroentangling jet strip 10, a test setup was designed and constructed which allows for the production and imaging of a single-fluid stream profile. This test set-up may be used to examine the profiles of fluid streams issued from different nozzle orifices (and nozzles in communication therewith) at different pressures as well as their impact forces along their axis. FIGS. 5A-5B show the profiles of two different fluid streams issued from two similar nozzles having different inlet diameters of 65 μm (see FIG. 5A) and 130 μm (see FIG. 5B) at a pressure of 100 bars. It can be seen that the fluid stream issued from the nozzle with 65 μm inlet diameter has an apparent breakup length greater than 5 cm. Thus, most nozzle inlet diameters greater than about 65 μm should fall into the range of usable nozzle inlet diameters.

In order to measure the impact force of the various fluid streams on the fabric material 100 and compare our theoretical predictions via the momentum equation (Equation (2)) an experimental apparatus may be equipped with: (1) a compression load cell; (2) a load cell holder with an accurate height adjustment capability; and (3) a data acquisition system controlled by a personal computer or other computer device. The impact forces of various exemplary fluid streams were measured thereby and plotted in FIG. 7. Assuming a 90-degree deflection of the fluid stream after the impact with a flat plate (representing the relatively flat surface of the moving fabric material 110), the theoretical impact force of these fluid streams was calculated and plotted in FIG. 7 for comparison. As mentioned before, when a jet breaks up, its momentum is divided among thousands of fine droplets and its impact force is dispersed. Note that the results shown in FIG. 7 reveal a decline in the impact force of the jet from the nozzles with a diameter of 65 μm after at a particular distance away from the nozzle exit. Nevertheless, the impact force of this jet is still in agreement with the theoretical results of Equation (2) for the first 10 cm of its length (i.e. its "intact" length).

It should be understood that the impact force of a fluid stream with the fabric material 100 is numerically different from the above data obtained for a flat plate. However, the above proportionality between the impact force and nozzle orifice diameter remains valid and these results can qualitatively be used to design an optimal elongate hydroentangling jet strip 10 defining one or more rows 12, 14, 16 of nozzles (in communication with corresponding nozzle orifices).

The invention also provides hydroentangled nonwoven fabrics 110 prepared by the method of the present invention. The fabrics of the invention are characterized by reduced heights of jet streaks and, thus, reduced optical visibility of jet streaks. The fabrics also have tensile strength and tear strength properties that are advantageous as compared to known hydroentangled nonwoven fabrics. For example, in some embodiments, various method and/or system embodiments may be capable of providing nonwoven fabrics produced by moving a sheet of fabric material 100 in a processing direction 5 adjacent to at least one hydroentangling jet strip 10. In some such embodiments, the nonwoven fabric 110 produced thereby may comprise a plurality of ridges 300 extending substantially parallel to the processing direction 5 and having a reduced height (that may be indicated, for example, by a 50% to 80% reduction in optical "streakiness" of the nonwoven fabric 110 (as shown, for example, in FIGS. 16 and 17)). This reduction in "streakiness" may be visualized and/or quantified as a reduction in grayscale contrast between each ridge 300 and each "valley" disposed laterally adjacent to the ridge 300. More particularly, a co-occurrence analysis may be performed to quantify a reduction in contrast between the typically "light" ridges 300 and the adjacent "dark" areas that may be indicative of a "valley" created by one or more fluid streams impacting the fabric material 100. To obtain a quantitative measure of the reduction in ridges 300 achieved by some embodiments of the present invention, a co-occurrence texture analysis procedure may be utilized. For example, a nonwoven fabric 110 sample may be imaged, and analyzed using a co-occurrence method as described, for example, by Shim, E., and Pourdeyhimi, B., (2005) *Textile Research Journal* 75(7): 569-577., which is hereby incorporated herein by reference in its entirety. The results of such an exemplary analysis are presented in FIGS. 11A, 11B, 13A, and 13B (as described in the Experimental Example presented herein).

In some embodiments, the nonwoven fabric 110 may exhibit substantial increases in tear strength (when compared to control fabrics produced using conventional hydroentangling methods). For example, as described herein with respect to the Experimental Example, sample nonwoven fabrics 110 produced using various embodiments of the present invention exhibited tear strengths from about 15% to about 50% greater than control nonwoven fabrics produced using conventional hydroentangling methods. Furthermore, in some such embodiments, the nonwoven fabric 110 may exhibit a tensile strength in a direction substantially parallel to the processing direction 5 that is not substantially lower than comparable tensile strengths exhibited by nonwoven fabrics produced using conventional hydroentangling processes.

The following experimental example is presented herein by way of example and not by way of limitation.

EXPERIMENTAL EXAMPLE

To examine the performance of the various system and method embodiments of the present invention, a spun-bond web of Nylon/PET bicomponent fibers having an average diameter of 15 μm was prepared in the Nonwovens Laboratory of the Nonwovens Co-operative Research Center (NCRC), at North Carolina State University (NCSU) in Raleigh, N.C. Spun-bonding is a manufacturing technique, which offers a one-step process for producing a finished nonwoven fabric 110 from the raw materials 100 (thermoplastic polymers) as the fiber and fabric production are combined. The basis weight, $W_b$, (defined as the mass per unit of area) of spun-bonded fabrics typically lie between 10 to 200 g/m$^2$. The fabric 110 produced here has a basis weight of about 150 g/m$^2$.

For proof of concept of one particular embodiment of the present invention, a four-row elongate hydroentangling jet strip 10 (such as that shown in FIG. 1A, for example) (wherein d1=130 μm, d2=110 μm, d3=d4=100 μm) in the last manifold that the fabric material 100 would pass through (for example, manifold no. 3 in FIG. 2). The operating pressure considered for this manifold was 200 bars. The spun-bonded web was pre-entangled at a pressure of 150 bar using 4 manifolds and corresponding hydroentangling jet strips engaged therewith (manifolds number 2 to 5 in FIG. 2) for 3 passes through the system shown generally in FIG. 3. It should be noted that manifold number 1 (see FIG. 3) is, in this example, used for "pre-wetting" the fabric material 100 for better entangling, and was run at an operating pressure of 30 bars throughout the experimental runs. It should be understood that commercial hydroentangled fabrics with basis weights of about 150 g/m$^2$ are normally treated with 10 to 15 manifolds to reach an acceptable degree of entanglement. For this purpose, 3×4 manifolds were included for pre-entangling the fabric material 100. Operating pressure used in this experimental example (where the control fabric and sample fabrics were compared) was 200 bars (in manifold number 5 in FIG. 3). FIG. 10 shows the resulting nonwoven fabrics 110 before (control fabric) and after treatment with the four-row elongate hydroentangling jet strip 10 (shown generally in FIG. 1A). It can be seen that the use of the elongate hydroentangling jet strip 10 remarkably reduces the incidence of ridges 300 ("jet streaks") in the finished nonwoven fabric 110.

To obtain a quantitative measure of the reduction in ridges 300 achieved by some embodiments of the present invention, a texture analysis procedure was utilized. For example, five different areas of each nonwoven fabric 110 sample were imaged, and analyzed using a co-occurrence method as described, for example, by Shim, E., and Pourdeyhimi, B., (2005) *Textile Research Journal* 75(7): 569-577., which is hereby incorporated herein by reference in its entirety. The nonwoven fabrics 110 were illuminated using macro-dark field illumination for better visibility. Spatial co-occurrence analysis was performed to evaluate the ridges' 300 periodicity. Prior to performing the co-occurrence analysis the images were converted to grayscale, and a central portion with a size of 400 pixel×400 pixel was chosen for the analysis.

The results of the co-occurrence analysis (shown in FIGS. 11A-11B, for example) reveal the presence of dominant peaks occurring at a period of about 600 μm for the ridges 300 in the control nonwoven fabric. As shown in FIG. 11, the corresponding co-occurrence results obtained from the sample nonwoven fabric 110 treated with a system according to one embodiment of the present invention shows co-occurrence analysis results that are indicative of ridges 300 having significantly reduced heights and/or amplitudes.

As described herein, various combinations of diameters (d1, d2) of the nozzle orifices within the successive rows of nozzle orifices 12, 14, 16 may be used to optimize the overall reduction in the height of ridges 300 ("jet streaks") in the finished nonwoven fabric 110. To investigate diameter combinations that improve the removal of jet-streaks, a simplified two-row elongate hydroentangling jet strip 10 (see FIG. 2, for example) was considered. For the purposes of this particular experimental example, the diameter d1 of the nozzle orifices in the first row of nozzle orifices 12 was kept constant at d1=130 μm, while the diameter d2 of the nozzle orifices in the second row of nozzle orifices 14 was varied from 100 μm to 130 μm in increments of 10 μm (see FIG. 2, for example).

For convenience, finished nonwoven fabrics 110 produces using a two-row embodiment of the system of the present invention are hereafter referred to as "sample." FIGS. 12A-12E show a series of images of the sample nonwoven fabrics 110 produced using a "two-row" elongate hydroentangling jet strip 10 (shown generally in FIG. 2). As shown in FIGS. 12A-12E the reduction in the ridges 300 jet-streaks is visible to the naked eye. Furthermore, the results of a co-occurrence analysis shown in FIG. 13A confirms that the quantitative reduction in the height of the ridges 300 in the nonwoven fabric 110 is significant (see, for example, the substantial reduction in optical contrast between each ridge 300 and adjacent "valleys" in "sample-110"). The power values shown in FIG. 13B generally represent the intensity of the ridges 300 jet-streaks in a finished nonwoven fabric 110. The obtained power curves represent the periodicity of the ridges 300 in the nonwoven fabrics 110 (occurring every 600 μm, for example), and the height of each curve indicates its dominance. In summary, "power" is generally indicative of the amplitude obtained from corresponding contrast curves. Thus, FIG. 13B strongly indicates that the exemplary embodiment of the present invention has markedly decreased the intensity of "jet-streaks" in the finished nonwoven fabrics 110.

It is generally known that the presence of jet-streaks in nonwoven fabric can weaken the tear resistance of the fabric. FIGS. 14A-14D show scanning electron microscope (SEM) images of the nonwoven fabric's cross section. These SEM images clearly show that the thickness of the fabric is reduced in the "valleys" disposed between adjacent ridges 300 ("jet-streaks") as the fibers are pushed away from these areas. Note also the deep grooves in the control fabric (FIGS. 14A-14B) with a spacing of about 600 μm which are produced by the impact of the fluid streams generated by the nozzle orifices. Note that 600 μm is also the spacing between the nozzle orifices used in this study. These valleys or grooves can cause stress concentration in the nonwoven fabric 110 and therefore, decrease the tear resistance of the fabric 110 in the processing direction 5. Such non-uniformities are greatly reduced in the "sample-110" generated using the system and method embodiments of the present invention as the fibers of the nonwoven fabric 110 are better spread (see FIGS. 14C-14D, for example).

To examine the quantitative effects of the embodiments of the present invention in improving the nonwoven fabric 110 strength, the samples' tear resistance was evaluated in the processing direction 5 and compared to corresponding tear strength of the control fabric. The tear test measures the force required to tear a textile specimen in which a tear is initiated prior to testing. More particularly, according to ASTM D2261-96 "Standard Test Method for Tearing Strength of Fabrics by the Tongue (Single Rip) Procedure (Constant-Rate-of-Extension Tensile Testing Machine)" a rectangular specimen (75 mm×200 mm) of the nonwoven fabric 110 was precut in the center of the long edge to form a two-tongued or "trouser-shaped" specimen. One tongue was clamped into the lower jaw of the machine and the other was clamped into the upper jaw. During the measurement, the distance between the jaws increases and the force applied to the fabric, due to the movement of the jaws, propagates the tear. FIGS. 15A-15B shows two specimens representing the rupture propagation in the control and "sample-110" nonwoven fabrics 110. It can be seen that the rupture propagates along the ridges 300 ("jet streaks") in the case of control fabrics (see FIG. 15A). This is because the jet-streaks create areas of minimum resistance which are generally aligned in the processing direction 5. The rupture front in the case of sample-110 (see FIG. 15B), however, did propagate in a straight line. Tear in this case tends to follow a path of minimum resistance which is not necessarily in the processing direction 5.

During the tear test, the force required to move the clamps was also recorded. FIG. 16 shows the force-strain curves obtained from conducting the tear test on five (5) replicates of the control and "sample-110" nonwoven fabrics 110. The results were normalized with the average resistance of the control fabric for a better comparison. An improvement of about 25% (and, in some cases, up to 50%) in the tear resistance of the fabric produced using embodiments of the present invention is evident. Similar tests have also been performed on "sample-100", "sample-120", and "sample-130," which were also produced using various embodiments of the present invention. These results are generally in agreement with the results of the co-occurrence experiment, and reveal that "sample-110" has the most uniform surface and the highest tear resistance. The load values increase rapidly with the strain and reach a plateau after an elongation of about 100% where they start fluctuating until the specimen nonwoven fabric 110 is completely ruptured. The initial increase in the load is the force needed to bring the fabric under tension without the rupture front moving. The tear resistance is averaged from the point where the rupture front starts moving towards the end of specimen (i.e., at about 100% elongation), until failure occurs. The average load of the control fabric is may be used to normalize the tear resistance of all the samples for better comparison. The average normalized tear resistances of the samples and their corresponding standard deviations are shown in Table 1 below.

TABLE 1

| | Sample-100 | Sample-110 | Sample-120 | Sample-130 |
|---|---|---|---|---|
| Normalized Average Tear Strength | 1.11 | 1.30 | 1.28 | 1.20 |
| Standard Deviation | 0.02 | 0.03 | 0.01 | 0.03 |

As one skilled in the art will appreciate, it is important that hydroentangled fabrics maintain their strength against tensile load. It is important to ensure that amending the tear resistance of the fabrics does not damage their tensile properties. For this reason all the nonwoven fabric 110 samples produced using exemplary embodiments of the present invention were examined using the tensile test methods outlined in ASTM D 5035-95 entitled "Standard Test Method for Breaking Force and Elongation of Textile Fabrics (Strip Method)". This test reports the force required to tear a textile specimen in the tensile direction. In accordance with this method, a rectangular specimen (25 mm×150 mm) of the nonwoven fabric 110 is mounted on the upper and lower jaw of a tensile testing machine with its long dimension parallel to the direction of force application. The distance between the jaws is increased until the break of the fabric occurs, caused by the force applied to the specimen. The force required to break the textile specimen and the elongation of the specimen are reported during the measurement.

FIG. 17 shows the force-strain curves obtained from conducting the above-referenced tensile test on 5 replicates of the control and sample-110 nonwoven fabrics 110. These results are normalized with the maximum average tensile strength of the control nonwoven fabric for a better comparison. FIG. 17 reveals that there is no

TABLE 2

| | Sample-100 | Sample-110 | Sample-120 | Sample-130 |
|---|---|---|---|---|
| Normalized Average Tensile Strength | 1.09 | 1.01 | 0.98 | 1.01 |
| Standard Deviation | 0.06 | 0.05 | 0.03 | 0.02 |

substantial change in the tensile properties of the sample-110 in the processing direction 5. The normalized average tensile strengths of the sample-100, sample-120, and sample-130 are shown in Table 2 for comparison. The vales are normalized using the average maximum (at rupture) tensile strength of the control fabric for a better comparison. It is evident that none of the sample fabrics show any substantial reduction in their tensile properties.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A system for hydroentangling a sheet of fabric material moving in a processing direction to form a nonwoven fabric, the system comprising an elongate hydroentangling jet strip comprising a plurality of nozzle orifices, each operatively positioned to direct a stream of hydroentangling fluid toward the sheet of fabric material, the plurality of nozzle orifices comprising:

a first row of nozzle orifices spaced apart along the width of the elongate hydroentangling jet strip, each of the nozzle orifices in the first row having a first diameter; and a second row of nozzle orifices disposed downstream from the first row of nozzle orifices in the processing direction and spaced apart along the width of the elongate hydroentangling jet strip, each nozzle orifice of the second row of nozzle orifices being offset at a selected distance from the closest nozzle orifices of the first row of nozzle orifices along the width of the elongate hydroentangling jet strip such that a nozzle orifice of the second row is laterally offset between each pair of nozzle orifices of the first row, each of the nozzle orifices in the second row having a second diameter being smaller than the first diameter.

2. The system of claim 1, wherein the streams of hydroentangling fluid exiting the first row of nozzle orifices create ridges in the sheet of fabric material, and wherein the second row of nozzle orifices are operatively positioned such that the streams of hydroentangling fluid exiting the second row of nozzle orifices reduces a height of the ridges.

3. The system of claim 1, wherein the second row of nozzle orifices are offset at the selected distance from the first plurality of orifices such that a center of each of the second row of nozzle orifices is substantially equidistant from a center of each of a pair of nozzle orifices of the first row positioned closest to each of the second row of nozzle orifices.

4. The system of claim 1, wherein the second diameter is at least about 30% of the first diameter.

5. The system of claim 1, wherein the second diameter is at least about 50% of the first diameter.

6. The system of claim 1, wherein the second diameter is at least about 65% of the first diameter.

7. The system of claim 1, wherein the second diameter is no more than about 95% of the first diameter.

8. The system of claim 1, wherein the second diameter is no more than about 90% of the first diameter.

9. The system of claim 1, wherein the second diameter is no more than about 85% of the first diameter.

10. The system of claim 1, wherein the first diameter is between about 120 μm and 160 μm and wherein the second diameter is between about 80 μm and 140 μm.

11. The system of claim 1, wherein the first diameter is about 130 μm and wherein the second diameter is about 110 μm.

12. The system of claim 1, wherein the first diameter is about 110 μm and wherein the second diameter is about 90 μm.

13. The system of claim 1, wherein the second row of nozzle orifices are spaced apart from the first row of nozzle orifices in the processing direction at a distance of about one half of the distance between each center of an adjacent pair of the first row of nozzle orifices.

14. The system of claim 1, wherein the plurality of nozzle orifices further comprises one or more additional rows of nozzle orifices disposed downstream from the second row of nozzle orifices in the processing direction, each of the nozzle orifices of the one or more additional rows of nozzle orifices being spaced apart along the width of the elongate hydroentangling jet strip, each of the one or more additional rows of nozzle orifices being offset at a selected distance from the nearest upstream row of nozzle orifices along the width of the elongate hydroentangling jet strip, and each of the nozzle orifices of the one or more additional rows having a diameter that is less than or equal to the second diameter.

15. The system of claim 1, wherein the selected distance is measured along the width of the elongate hydroentangling jet strip from a center of at least one of the first row of nozzle orifices to a line extending in the processing direction from a center of a nearest one of the second row of nozzle orifices, and wherein the selected distance is greater than or equal to a sum of one half of the first diameter and one half of the second diameter.

16. The system of claim 1, wherein the selected distance is measured along the width of the elongate hydroentangling jet strip from a center of at least one of the first row of nozzle orifices to a line extending in the processing direction from a center of a nearest one of the second row of nozzle orifices, and wherein the selected distance is greater than or equal to the first diameter.

17. The system of claim 1, wherein the selected distance is measured along the width of the elongate hydroentangling jet strip from a center of at least one of the first row of nozzle orifices to a line extending in the processing direction from a center of a nearest one of the second row of nozzle orifices, and wherein the selected distance is greater than or equal to a sum of the first diameter and the second diameter.

18. The system of claim 1, wherein the selected distance is measured along the width of the elongate hydroentangling jet strip from a center of at least one of the first row of nozzle orifices to a line extending in the processing direction from a center of a nearest one of the second row of nozzle orifices, and wherein the selected distance is the same as a distance defined between a first line extending through the centers of each of the first row of nozzle orifices and a second line extending through the centers of each of the second row of nozzle orifices.

19. A method for hydroentangling a sheet of fabric material moving in a processing direction to form a nonwoven fabric, the method comprising:

advancing the fabric material in the processing direction;

subjecting the fabric material to a first plurality of fluid streams, the first plurality of fluid streams spaced apart from one another along a width of the fabric material substantially perpendicular to the processing direction, the first plurality of fluid streams configured for impacting the fabric material with a first force intensity to form the nonwoven fabric having a plurality of ridges extending along a length of the nonwoven fabric between each of the first plurality of fluid streams; and subjecting the nonwoven fabric to a second plurality of fluid streams, the second plurality of fluid streams disposed downstream from the first plurality of fluid streams in the processing direction, each of the second plurality of fluid streams being offset at a selected distance from the closest fluid streams of the first plurality of fluid streams along the width of the fabric material such that a fluid stream of the second plurality of fluid streams is laterally offset between each pair of fluid streams of the first plurality of fluid streams, such that the second plurality of fluid streams impact the plurality of ridges with a second force intensity less than the first force intensity, so as to at least partially reduce a height of each of the plurality of ridges in the nonwoven fabric.

20. The method of claim 19, wherein subjecting the fabric material to the first plurality of fluid streams farther comprises forcing a fluid through a first plurality of orifices defined in an elongate hydroentangling jet strip extending across the width of the fabric material, and wherein subjecting the nonwoven fabric to a second plurality of fluid streams comprises forcing the fluid through a second plurality of nozzle orifices defined in the elongate hydroentangling jet strip and offset at the selected distance from the first plurality of orifices along the width of the elongate hydroentangling jet strip.

21. The method of claim 20, wherein each of the first plurality of orifices include a first diameter and wherein each of the second plurality of orifices include a second diameter being smaller than the first diameter.

22. The method of claim 21, wherein the second diameter is at least about 30% of the first diameter.

23. The method of claim 21, wherein the second diameter is at least about 50% of the first diameter.

24. The method of claim 21, wherein the second diameter is at least about 65% of the first diameter.

25. The method of claim 21, wherein the second diameter is no more than about 95% of the first diameter.

26. The method of claim 21, wherein the second diameter is no more than about 90% of the first diameter.

27. The method of claim 21, wherein the second diameter is no more than about 85% of the first diameter.

28. The method of claim 21, wherein the first diameter is between about 120 μm and 160 μm and wherein the second diameter is between about 80 μm and 140 μm.

29. The method of claim 21, wherein the first diameter is about 130 μm and wherein the second diameter is about 110 μm.

30. The method of claim 21, wherein the first diameter is about 110 μm and wherein the second diameter is about 90 μm.

31. The method of claim 20, wherein the selected distance is measured along the width of the elongate hydroentangling jet strip from a center of at least one of the first row of nozzle orifices to a line extending in the processing direction from a center of a nearest one of the second row of nozzle orifices, and wherein the selected distance is greater than or equal to a sum of one half of the first diameter and one half of the second diameter.

32. The method of claim 20, wherein the selected distance is measured along the width of the elongate hydroentangling jet strip from a center of at least one of the first row of nozzle orifices to a line extending in the processing direction from a center of a nearest one of the second row of nozzle orifices, and wherein the selected distance is greater than or equal to the first diameter.

33. The method of claim 20, wherein the selected distance is measured along the width of the elongate hydroentangling jet strip from a center of at least one of the first row of nozzle orifices to a line extending in the processing direction from a center of a nearest one of the second row of nozzle orifices, and wherein the selected distance is greater than or equal to a sum of the first diameter and the second diameter.

34. The method of claim 20, wherein the selected distance is measured along the width of the elongate hydroentangling jet strip from a center of at least one of the first row of nozzle orifices to a line extending in the processing direction from a center of a nearest one of the second row of nozzle orifices, and wherein the selected distance is the same as a distance defined between a first line extending through the centers of each of the first row of nozzle orifices and a second line extending through the centers of each of the second row of nozzle orifices.

35. A system for hydroentangling a sheet of fabric material moving in a processing direction to form a nonwoven fabric, the system comprising an elongate hydroentangling jet strip comprising a plurality of nozzle orifices, each operatively positioned to direct a stream of hydroentangling fluid toward the sheet of fabric material, the plurality of nozzle orifices comprising:

a first row of nozzle orifices spaced apart along the width of the elongate hydroentangling jet strip, each of the nozzle orifices in the first row having a first diameter;

a second row of nozzle orifices disposed downstream from the first row of nozzle orifices in the processing direction and spaced apart along the width of the elongate hydroentangling jet strip, the second row of nozzle orifices being offset at a selected distance from the first row of nozzle orifices along the width of the elongate hydroentangling jet strip, each of the nozzle orifices in the second row having a second diameter being smaller than the first diameter; and wherein the second row of nozzle orifices are offset at the selected distance from the first plurality of orifices such that a center of each of the second row of nozzle orifices is substantially equidistant from a center of each of a pair of nozzle orifices of the first row positioned closest to each of the second row of nozzle orifices.

* * * * *